US007363227B2

(12) United States Patent
Mapes-Riordan et al.

(10) Patent No.: US 7,363,227 B2
(45) Date of Patent: Apr. 22, 2008

(54) DISRUPTION OF SPEECH UNDERSTANDING BY ADDING A PRIVACY SOUND THERETO

(75) Inventors: Daniel Mapes-Riordan, Evanston, IL (US); Jeffrey Specht, Wyoming, MI (US); William DeKruif, deceased, late of Winnetka, IL (US); by Susan Ell, legal representative, St. Peters, MO (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 11/588,979

(22) Filed: Oct. 27, 2006

(65) Prior Publication Data

US 2007/0203698 A1 Aug. 30, 2007

Related U.S. Application Data

(63) Continuation-in-part of application No. 11/326,269, filed on Jan. 4, 2006.

(60) Provisional application No. 60/642,865, filed on Jan. 10, 2005, provisional application No. 60/684,141, filed on May 24, 2005, provisional application No. 60/731,100, filed on Oct. 29, 2005.

(51) Int. Cl.
*G10L 21/00* (2006.01)

(52) U.S. Cl. ..... 704/273

(58) Field of Classification Search ..... 704/273
See application file for complete search history.

(56) References Cited

U.S. PATENT DOCUMENTS

| | | | | |
|---|---|---|---|---|
| 3,541,258 | A | 11/1970 | Doyle et al. | |
| 3,718,765 | A | 2/1973 | Halaby | |
| 3,879,578 | A | 4/1975 | Wildi | |
| 4,068,094 | A | 1/1978 | Schmid et al. | |
| 4,099,027 | A | 7/1978 | Whitten | |
| 4,195,202 | A | 3/1980 | McCalmont | |
| 4,232,194 | A | 11/1980 | Adams | |
| 4,438,526 | A | 3/1984 | Thomalla | |
| 4,852,170 | A | 7/1989 | Bordeaux | |
| 4,905,278 | A | 2/1990 | Parker | |
| 5,036,542 | A | 7/1991 | Kehoe et al. | |
| 5,355,430 | A * | 10/1994 | Huff | 704/223 |
| 5,781,640 | A | 7/1998 | Nicolino, Jr. | |
| 6,188,771 | B1 | 2/2001 | Horrall | |
| 6,888,945 | B2 | 5/2005 | Horrall | |
| 7,143,028 | B2 | 11/2006 | Hillis et al. | |
| 2003/0091199 | A1 | 5/2003 | Horrall et al. | |
| 2004/0019479 | A1 | 1/2004 | Hillis et al. | |
| 2004/0125922 | A1 | 7/2004 | Specht | |
| 2005/0065778 | A1 * | 3/2005 | Mastrianni et al. | 704/200.1 |
| 2006/0009969 | A1 | 1/2006 | L'Esperance et al. | |
| 2006/0109983 | A1 | 5/2006 | Young et al. | |

* cited by examiner

*Primary Examiner*—Tālivaldis Ivars Šmits
*Assistant Examiner*—Donald L. Storm
(74) *Attorney, Agent, or Firm*—Brinks, Hofer Gilson & Lione

(57) ABSTRACT

A privacy apparatus adds a privacy sound into the environment, thereby confusing listeners as to which of the sounds is the real source. The privacy sound may be based on the speaker's own voice or may be based on another voice. At least one characteristic of the speaker (such as a characteristic of the speaker's speech) may be identified. The characteristic may then be used to access a database of the speaker's own voice or another's voice, and to form one or more voice streams to form the privacy sound. The privacy sound may thus permit disruption of the ability to understand the source speech of the user by eliminating segregation cues that the auditory system uses to interpret speech.

33 Claims, 15 Drawing Sheets

DISRUPTION OF SPEECH UNDERSTANDING BY ADDING A PRIVACY SOUND THERETO

RELATED APPLICATIONS

This application is a continuation-in-part of U.S. patent application Ser. No. 11/326,269 filed on Jan. 4, 2006, which claims the benefit of U.S. Provisional Application No. 60/642,865, filed Jan. 10, 2005, the benefit of U.S. Provisional Application No. 60/684,141, filed May 24, 2005, and the benefit of U.S. Provisional Application No. 60/731,100, filed Oct. 29, 2005. U.S. patent application Ser. No. 11/326,269, U.S. Provisional Application No. 60/642,865, U.S. Provisional Application No. 60/684,141, and U.S. Provisional Application No. 60/731,100 are hereby incorporated by reference herein in their entirety.

FIELD

The present application relates to a method and apparatus for disrupting speech and more specifically, a method and apparatus for disrupting speech from a single talker or multiple talkers.

BACKGROUND

Office environments have become less private. Speech generated from a talker in one part of the office often travels to a listener in another part of the office. The clearly heard speech often distracts the listener, potentially lowering the listener's productivity. This is especially problematic when the subject matter of the speech is sensitive, such as patient information or financial information.

The privacy problem in the workplace has only worsened with the trend in office environments for open spaces and increased density of workers. Many office environments shun traditional offices with four walls in favor of cubicles or conference rooms with glass walls. While these open spaces may facilitate interaction amongst coworkers, speech more easily travels leading to greater distraction and less privacy.

There have been attempts to combat the noise problem. The typical solution is to mask or cover-up the noise problem with "white" or "pink" noise. White noise is a random noise that contains an equal amount of energy per frequency band. Pink noise is noise having higher energy in the low frequencies. However, masking or covering-up the speech in the workplace is either ineffective (because the volume is too low) or overly distracting (because the volume must be very high to disrupt speech). Thus, the current solutions to solve the noise problem in the workplace are of limited effectiveness.

BRIEF SUMMARY

A system and method for disrupting speech of a talker at a listener in an environment is provided. The system and method comprise determining a speech database, selecting a subset of the speech database, forming at least one speech stream from the subset of the speech database, and outputting at least one speech stream.

In one aspect of the invention, any one, some, or all of the steps may be based on a characteristic or multiple characteristics of the talker, the listener, and/or the environment. Modifying any one of the steps based on characteristics of the talker, listener, and/or environment enables varied and powerful systems and methods of disrupting speech. For example, the speech database may be based on the talker (such as by using the talker's voice to compile the speech database) or may not be based on the talker (such as by using voices other than the talker, for example voices that may represent a cross-section of society). For a database based on the talker, the speech in the database may include fragments generating during a training mode and/or in real-time. As another example, the speech database may be based both on the talker and may not be based on the talker (such as a database that is a combination of the talker's voice and voices other than the talker). Moreover, once the speech database is determined, the selection of the subset of the speech database may be based on the talker. Specifically, vocal characteristics of the talker, such as fundamental frequency, formant frequencies, pace, pitch, gender, and accent, may be determined. These characteristics may then be used to select a subset of the voices in the speech database, such as by selecting voices from the database that have similar characteristics to the characteristics of the talker. For example, in a database comprised of voices other than the talker, the selection of the subset of the speech database may comprise selecting speech (such as speech fragments) that have the same or the closest characteristics to speech of the talker.

Once selected, the speech (such as the speech fragments) may be used to generate one or more voice streams. One way to generate the voice stream is to concatenate speech fragments. Further multiple voice streams may be generated by summing individual voice streams, with the summed individual voice streams being output on loudspeakers positioned proximate to or near the talker's workspace and/or on headphones worn by potential listeners. The multiple voice streams may be composed of fragments of the talker's own voice or fragments not of the talker's own voice. A listener listening to sound emanating from the talker's workspace may be able to determine that speech is emanating from the workspace, but unable to separate or segregate the sounds of the actual conversation and thus lose the ability to decipher what the talker is saying. In this manner, the privacy apparatus disrupts the ability of a listener to understand the source speech of the talker by eliminating the segregation cues that humans use to interpret human speech. In addition, since the privacy apparatus is constructed of human speech sounds, it may be better accepted by people than white noise maskers as it sounds like the normal human speech found in all environments where people congregate. This translates into a sound that is much more acceptable to a wider audience than typical privacy sounds.

In another aspect, the disrupting of the speech may be for single talker or multiple talkers. The multiple talkers may be speaking in a conversation (such as asynchronous speaking where one talker to the conversation speaks and then a second talker to the conversation speaks or simultaneously when both talkers speak at the same time) or may be speaking serially (such as a first talker speaking in an office, leaving the office, and the second talker speaking in the office). In either manner, the system and method may determine characteristics of one, some, or all of the multiple talkers and determine a signal for disruption of the speech of the multiple talkers based on the characteristics.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. Moreover, in the figures, like referenced numerals designate corresponding parts throughout the different views.

DETAILED DESCRIPTION

A privacy apparatus is provided that adds a privacy sound into the environment that may closely match the characteristics of the source (such as the one or more persons speaking), thereby confusing listeners as to which of the sounds is the real source. The privacy apparatus may be based on a talker's own voice or may be based on other voices. This permits disruption of the ability to understand the source speech of the talker by eliminating segregation cues that humans use to interpret human speech. The privacy apparatus reduces or minimizes segregation cues. The privacy apparatus may be quieter than random-noise maskers and may be more easily accepted by people.

A sound can overcome a target sound by adding a sufficient amount of energy to the overall signal reaching the ear to block the target sound from effectively stimulating the ear. The sound can also overcome cues that permit the human auditory system segregate the sources of different sounds without necessarily being louder than the target sounds. A common phenomenon of the ability to segregate sounds is known as the "cocktail party effect." This effect refers to the ability of people to listen to other conversations in a room with many different people speaking. The means by which people are able to segregate different voices will be described later.

The privacy apparatus may be used as a standalone device, or may be used in combination with another device, such as a telephone. In this manner, the privacy apparatus may provide privacy for a talker while on the telephone. A sample of the talker's voice signal may be input via a microphone (such as the microphone used in the telephone handset or another microphone) and scrambled into an unintelligible audio stream for later use to generate multiple voice streams that are output over a set of loudspeakers. The loudspeakers may be located locally in a receptacle containing the physical privacy apparatus itself and/or remotely away from the receptacle. Alternatively, headphones may be worn by potential listeners. The headphones may output the multiple voice streams so that the listener may be less distracted by the sounds of the talker. The headphones also do not significantly raise the noise level of the workplace environment. In still another embodiment, loudspeakers and headphones may be used in combination.

Figure 1:
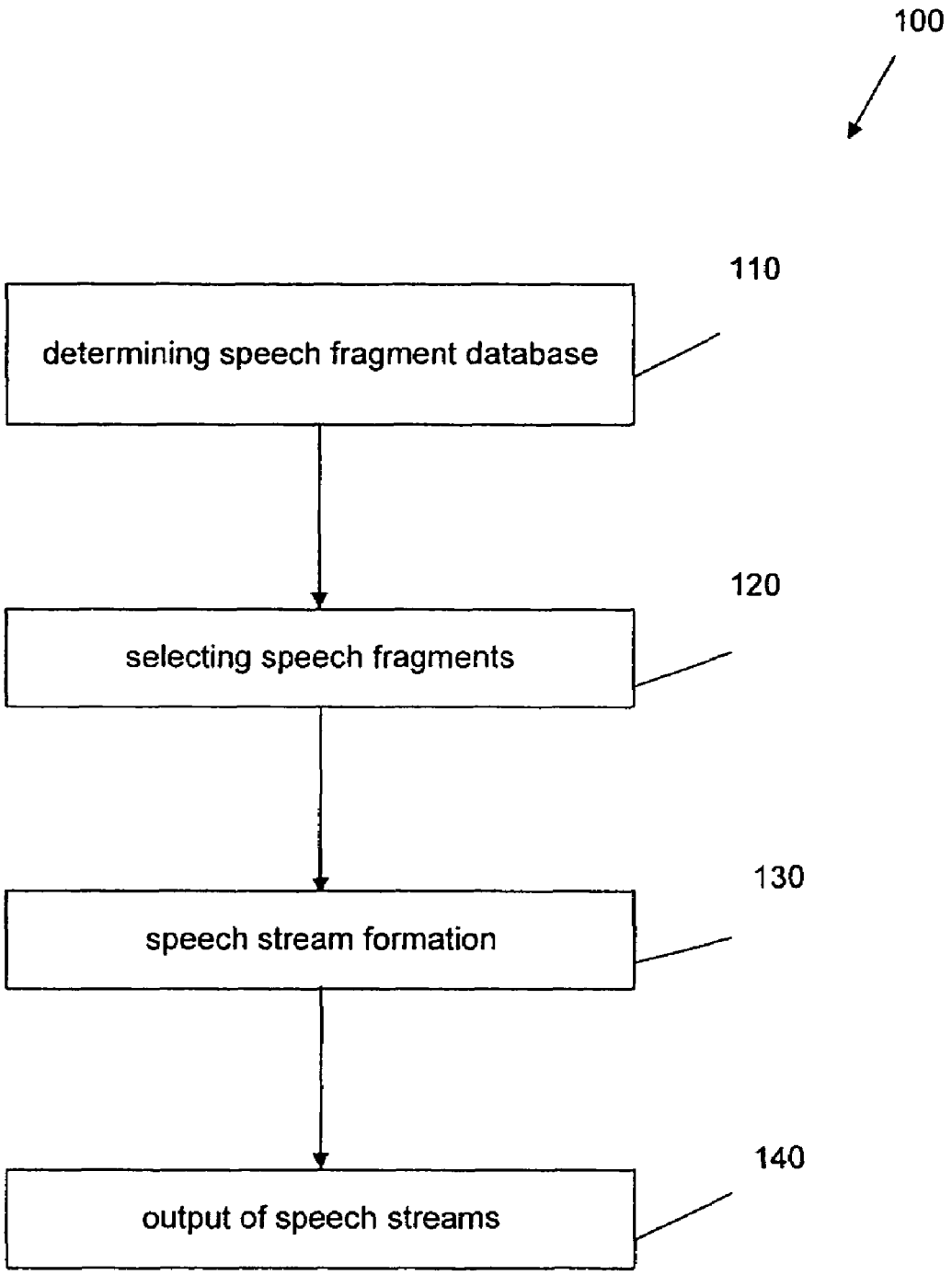
FIG. 1 is an example of a flow diagram for speech disruption output.

Referring to FIG. 1, there is shown one example of a flow diagram 100 for speech disruption output. In one aspect, the speech disruption output may be generated in order to provide privacy for talker(s) and/or to provide distractions for listener(s). FIG. 1 comprises four steps including determining a speech fragment database (block 110), selecting speech fragments (block 120), forming speech stream(s) (block 130), and outputting the speech streams (block 140). The steps depicted in FIG. 1 are shown for illustrative purposes and may be combined or subdivided into fewer, greater, or different steps.

As shown at block 110, the speech fragment database is determined. The database may comprise any type of memory device (such as temporary memory (e.g., RAM) or more permanent memory (e.g., hard disk, EEPROM, thumb drive)). As discussed below, the database may be resident locally (such as a memory connected to a computing device) or remotely (such as a database resident on a network). The speech fragment database may contain any form that represents speech, such as an electronic form of .wav file that, when used to generate electrical signals, may drive a loudspeaker to generate sounds of speech. The speech that is stored in the database may be generated based on a human being (such as person speaking into a microphone) or may be simulated (such as a computer simulating speech to create "speech-like" sounds). Further, the database may include speech for a single person (such as the talker whose speech is sought to be disrupted) or may include speech from a plurality of people (such as the talker and his/her coworkers, and/or third-parties whose speech represents a cross-section of society).

The speech fragment database may be determined in several ways. The database may be determined by the system receiving speech input, such as a talker speaking into a microphone. For example, the talker whose speech is to be disrupted may, prior to having his/her speech disrupted, initialize the system by providing his/her voice input. Or, the talker whose speech is to be disrupted may in real-time provide speech input (e.g., the system receives the talker's voice just prior to generating a signal to disrupt the talker's speech). The speech database may also be determined by accessing a pre-existing database. For example, sets of different types of speech may be stored in a database, as described below with respect to FIG. 4. The speech fragments may be determined by accessing all or a part of the pre-existing database.

When the system receives speech input, the system may generate fragments in a variety of ways. For example, fragments may be generated by breaking up the input speech into individual phoneme, diphone, syllable, and/or other like speech fragments. An example of such a routine is provided in U.S. application Ser. No. 10/205,328 (U.S. Patent Publication 2004-0019479), herein incorporated by reference in its entirety. The resulting fragments may be stored contiguously in a large buffer that can hold multiple minutes of speech fragments. A list of indices indicating the beginning and ending of each speech fragment in the buffer may be kept for later use. The input speech may be segmented using phoneme boundary and word boundary signal level estimators, such as with time constants from 10 ms to 250 ms, for example. The beginning/end of a phoneme may be indicated when the phoneme estimator level passes above/below a preset percentage of the word estimator level. In addition, in one aspect, only an identified fragment that has a duration within a desired range (e.g., 50-300 ms) may be used in its entirety. If the fragment is below the minimum duration, it may be discarded. If the fragment is above the maximum duration, it may be truncated. The speech fragment may then be stored in the database and indexed in a sample index.

As another example, fragments may be generated by selecting predetermined sections of the speech input. Specifically, clips of the speech input may be taken to form the fragments. In a 1 minute speech input, for example, clips ranging from 30 to 300 ms may be taken periodically or randomly from the input. A windowing function may be applied to each clip to smooth the onset and offset transitions (5-20 ms) of the clip. The clips may then be stored as fragments.

Block 110 of FIG. 1 describes that the database may comprise fragments. However, the database may store speech in non-fragmented form. For example, the talker's input may be stored non-fragmented in the database. As discussed below, if the database stores speech in non-fragmented form, the speech fragments may be generated when the speech fragments are selected (block 120) or when the speech stream is formed (block 130). Or, fragments may not need to be created when generating the disruption output. Specifically, the non-fragmented speech stored in the database may be akin to fragments (such as the talker inputting random, nonsensical sounds) so that outputting the non-fragmented speech provides sufficient disruption.

Further, the database may store single or multiple speech streams. The speech streams may be based on the talker's input or based on third party input. For example, the talker's input may be fragmented and multiple streams may be generated. In the clip example discussed above, a 2 minute input from a talker may generate 90 seconds of clips. The 90 seconds of clips may be concatenated to form a speech stream totaling 90 seconds. Additional speech streams may be formed by inserting a delay. For example, a delay of 20 seconds may create additional streams (i.e., a first speech stream begins at time=0 seconds, a second speech stream begins at time=20 seconds, etc.). The generated streams may each be stored separately in the database. Or the generated streams may be summed and stored in the database. For example, the streams may be combined to form two separate signals. The two signals may then be stored in the database in any format, such as an MP3 format, for play as stereo on a stationary or portable device, such as a cellphone or an portable digital player or other iPod® type device.

As shown at block 120, speech fragments are selected. The selection of the speech fragments may be performed in a variety of ways. The speech fragments may be selected as a subset of the speech fragments in the database or as the entire set of speech fragments in the database. The database may, for example, include: (1) the talker's speech fragments; (2) the talker's speech fragments and speech fragments of others (such as co-workers of the talker or other third parties); or (3) speech fragments of others. To select less than the entire database, the talker's speech fragments, some but not all of the sets of speech fragments, or the talker's speech fragments and some but not all of the sets of speech fragments may be selected. Alternatively, all of the speech fragments in the database may be selected (e.g., for a database with only a talker's voice, select the talker's voice; or for a database comprising multiple voices, select all of the multiple voices). The discussion below provides the logic for determining what portions of the database to select.

As shown at block 130, the speech stream is formed. As discussed in more detail below, the speech streams may be formed from the fragments stored in the database. However, if the speech streams are already stored in the database, the speech streams need not be recreated. As shown at block 140, the speech streams are output.

Any one, some, or all of the steps shown in FIG. 1 may be modified or tailored. The modification may be based on (1) one, some, or all of the talkers; (2) one, some, or all of the listeners; and/or (3) the environment of the talker(s) and/or listener(s). Modification may include changing any one of the steps depicted in FIG. 1 based on any one or a plurality of characteristics of the talker(s), listener(s) and/or environment.

For the four steps depicted in FIG. 1, there are potentially sixteen different combinations of steps based on whether each step is modified or non-modified. As discussed above, however, speech stream formation need not be performed. Some of the various combinations are discussed in more detail below. An example of a combination includes a speech fragment database determined in a non-modified manner (such as speech fragments stored in the database that are not dependent on the talker), speech fragments selected in a modified manner (such as selecting a subset of the speech fragments based on a characteristic of the talker), speech stream(s) formed in a non-modified manner, and speech streams output in a modified manner. Still another example includes a speech fragment database determined in a modified manner (such as storing speech fragments that are based on a characteristic of the talker), speech fragments selected in a non-modified manner (such as selecting all of the speech fragments stored in the database regardless of the talker), speech stream(s) formed in a non-modified manner, and speech streams output in a modified manner.

Characteristics of the talker(s) may include: (1) the voice of the talker (e.g., a sample of the voice output of the talker); (2) the identity of the talker (e.g., the name of the talker); (3) the attributes of the talker (e.g., the talker's gender, age, nationality, etc.); (4) the attributes of the talker's voice (e.g., dynamically analyzing the talker's voice to determine characteristics of the voice such as fundamental frequency, formant frequencies, pace, pitch, gender (voice tends to sound more male or more female), accent etc.); (5) the number of talkers; (6) the loudness of the voice(s) of the talker(s). Characteristics of the listener(s) may include: (1) the location of the listener(s) (e.g., proximity of the listener to the talker); (2) the number of listener(s); (3) the types of listener(s) (e.g., adults, children, etc.); (4) the activity of listener(s) (e.g., listener is a co-worker in office, or listener is a customer in a retail setting). Characteristics of the environment may include: (1) the noise level of the talker(s) environment; (2) the noise level of the listener(s) environment; (3) the type of noise of the talker(s) environment (e.g., noise due to other talkers, due to street noise, etc.); (4) the type of noise of the listener(s) environment (e.g., noise due to other talkers, due to street noise, etc.); etc.

For block 110, determining the speech fragment database may be modified or non-modified. For example, the speech fragment database may be determined in a modified manner by basing the database on the talker's own voice (such as by inputting the talker's voice into the database) or attributes of the talker's voice, as discussed in more detail with respect to FIG. 2. To supply the database with the talker's own voice, the talker may supply his/her voice in real-time (e.g., in the same conversation that is subject to disruption) or previously (such as during a training mode). The speech fragment database may also be determined in a non-modified manner by storing speech fragments not dependent on the talker characteristics, such as the talker's voice or talker's attributes. For example, the same speech fragments may be stored for some or all users of the system. As discussed in more detail below with respect to FIG. 4, the database may comprise samples of fragmented speech from many different people with a range of speech properties.

For block 120, selecting the speech fragments may be modified or non-modified. For example, the system may learn a characteristic of the talker, such as the identity of the talker or properties of the talker's voice. The system may then use the characteristic(s) to select the speech fragments, such as to choose a subset of the voices from the database depicted in FIG. 4 that most closely matches the talker's voice using the determined characteristic(s) as a basis of comparison, as discussed in FIGS. 6 and 8. For example, in a database that includes speech fragments of the talker and other voices, the real-time speech of the talker may be analyzed and compared with characteristics of the speech fragments stored in the database. Based on the analysis and comparison, the speech fragments of the talker that are stored in the database may be selected (if the real-time speech of the talker has the same or similar characteristics as the stored speech of the talker). Or, the speech fragments other than the talker that are stored in the database may be selected (e.g., if the talker has a cold and has different characteristics than the stored speech of the talker). As another example, the system may select the speech fragments regardless of the identity or other characteristics of the talker.

For block 130, forming the speech stream may be modified or non-modified. For block 140, outputting the speech streams may be modified or non-modified. For example, the system may output the speech streams based on a characteristic of the talker, listener, and/or environment. Specifically, the system may select a volume for the output based on the volume of the talker. As another example, the system may select a predetermined volume for the output that is not based on the volume of the talker.

Moreover, any one, some, or all of the steps in FIG. 1 may transition from non-modified to modified (and vice versa). For block 110 (determining the speech fragment database), the system may begin by determining a speech fragment database in a non-modified manner (e.g., the speech fragment database may comprise a collection of voice samples from individuals, with the voice samples being based on standard test sentences or other similar source material). As the talker interacts with the system, determining the speech fragment database may transition from non-modified to modified. For example, as the talker is talking, the system may input speech fragments from the talker's own voice, thereby dynamically creating the speech fragment database for the talker.

For block 120 (selecting the speech fragments), the system may transition from non-modified to modified. For example, before a system learns the characteristics of the talker, listener, and/or environment, the system may select the speech fragments in a non-modified manner (e.g., selecting speech fragments regardless of any characteristic of the talker). As the system learns more about the talker (such as the identity of the talker, the attributes of the talker, the attributes of the talker's voice, etc.), the system may tailor the selection of the speech fragments.

For block 130 (speech stream formation), the system may transition from non-modified to modified. For example, before a system learns the number of talkers, the system may generate a predetermined number of speech streams (such as four speech streams). After the system determines the number of talkers, the system may tailor the number of speech streams formed based on the number. For example, if more than one talker is identified, a higher number of speech streams may be formed (such as twelve speech streams).

For block 140 (output of speech streams), the system may transition from non-modified to modified. For example, before a system learns the environment of the talker and/or listener, the system may generate a predetermined volume for the output. After the system determines the environment of the talker and/or listener (such as background noise, etc.), the system may tailor the output accordingly, as discussed in more detail below. Or, the system may generate a predetermined volume that is constant. Instead of the system adjusting its volume to the talker (as discussed above), the talker may adjust his or her volume based on the predetermined volume.

Further, any one, some, or all of the steps in FIG. 1 may be a hybrid (part modified and part non-modified). For example, for block 110, the speech fragment database may be partly modified (e.g., the speech fragment database may store voice fragments for specific users) and may be partly non-modified. The database may thus include speech fragments as disclosed in both FIGS. 3 and 4. For block 120, the selecting of the speech fragments may be partly modified and partly non-modified. For example, if there are multiple talkers, with one talker being identified and the other not, the selection of speech fragments may be modified for the identified talker (e.g., if one talker is identified and the speech fragment database contains the talker's voice fragments, the talker's voice fragments may be selected) and non-modified for the non-identified talker. Or, if there is a single talker or multiple talkers, each of which are identified, the speech fragments accessed from the database may include both the speech fragments associated with the identified talkers as well as speech fragments not associated with the identified talkers (such as third-party generic speech fragments).

As discussed in more detail below with respect to FIG. 8, the optimum set of voices may be selected based on the speech detected. The optimum set may be used alone, or in conjunction with the talker's own voice to generate the speech streams. The optimum set may be similar to the talker's voice (such as selecting a male voice if the talker is determined to be male) or may be dissimilar to the talker's voice (such as selecting a female voice if the talker is determined to be male). Regardless, generating the voice streams with both the talker's voice and third party voices may effectively disrupt the talker's speech.

In addition, any one, some, or all of the steps in FIG. 1 may be modified depending on whether the system is attempting to disrupt the speech for a single talker (such as a person talking on the telephone) or for multiple talkers.

The multiple talkers may be speaking in a conversation, such as concurrently (where two people are speaking at the same time) or nearly concurrently (such as asynchronous where two people may speak one after the other). Or, the multiple talkers may be speaking serially (such as a first talker speaking in an office, leaving the office, and a second talker entering the office and speaking). In a conversation, the voice streams generated may be based on which of the two talkers is currently talking (e.g., the system may analyze the speech (including at least one characteristic of the speech) in real-time to sense which of the talkers is currently talking and generates voice streams for the current talker). Or, in a conversation, the voice streams may be based on one, some, or all the talkers to the conversation. Specifically, the voice streams generated may be based on one, some, or all the talkers to the conversation regardless of who is currently talking. For example, if it is determined that one of the talkers has certain attributes (such as the highest volume, lowest pitch, etc.), the voice stream may be based on the one or more talkers with the certain attributes.

In block 110, the determining of the speech fragment database may be different for a single talker as opposed to multiple talkers. For example, the speech fragment database for a single talker may be based on speech of the single talker (e.g., set of speech fragments based on speech provided by the single talker) and the speech fragment database for a multiple talkers may be based on speech of the multiple talkers (e.g., multiple sets of speech fragments, each of the multiple sets being based on speech provided by one of the multiple talkers). In block 120, the selecting of the speech fragments may be different for a single talker as opposed to multiple talkers, as described below with respect to FIG. 6. In block 130, the formation of the speech streams may be dependent on whether there is a single talker or multiple talkers. For example, the number of speech streams formed may be dependent on whether there is a single talker or multiple talkers, as discussed below with respect to FIG. 9.

Figure 2:
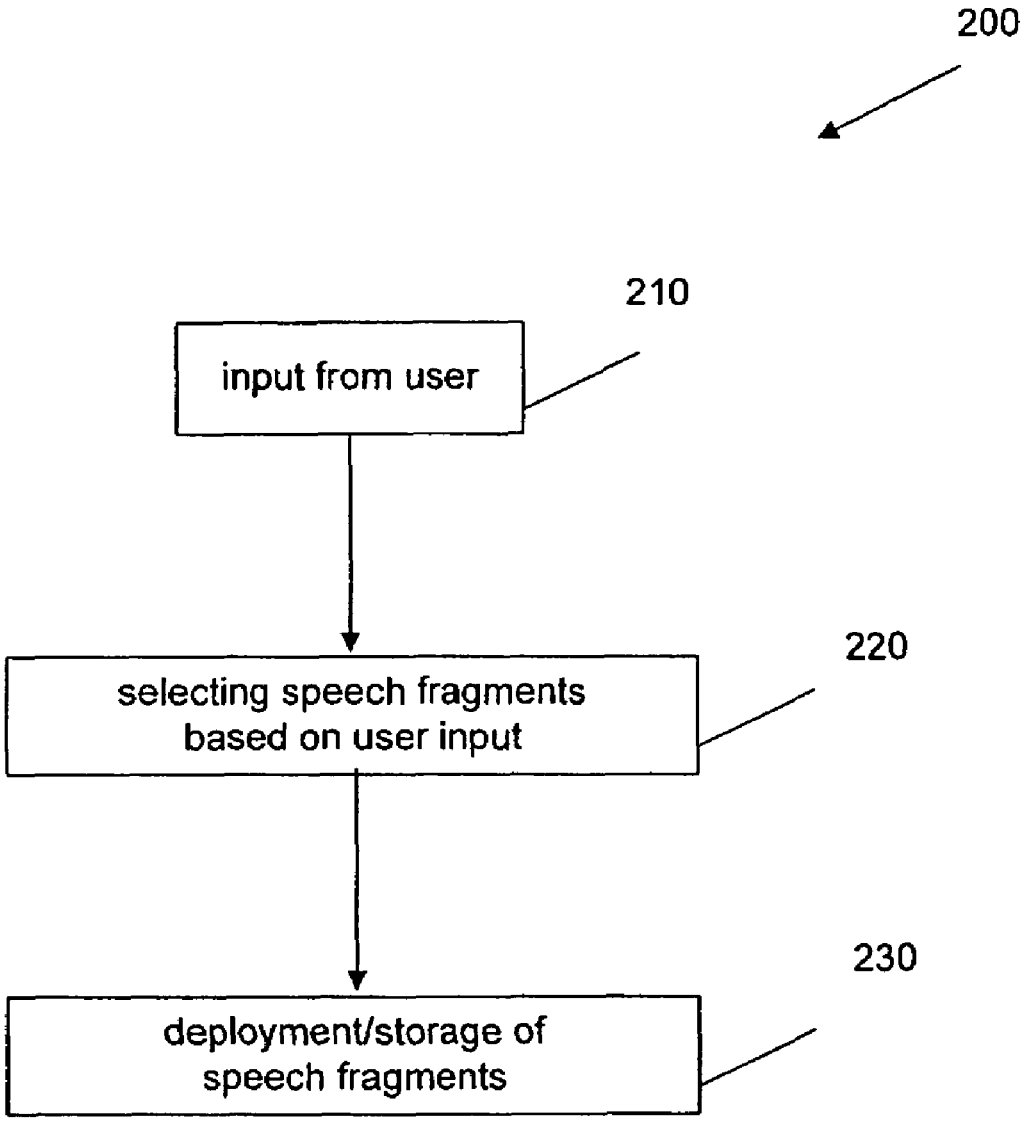
FIG. 2 is an example of a flow diagram for determining the speech fragment database in a modified manner.

Referring to FIG. 2, there is shown an example of a flow diagram 200 for determining the speech fragment database in a modified manner. As shown at block 210, the talker provides input. The input from the talker may be in a variety of forms, such as the actual voice of the talker (e.g., the talker reads from a predetermined script into a microphone) or attributes of the talker (e.g., the talker submits a questionnaire, answering questions regarding gender, age, nationality, etc.). Further, there are several modes by which the talker may provide the input. For example, in a standalone system (whereby all of the components of the system, including the input, database, processing, and output for the system, are self-contained), the talker may input directly to the system (e.g., speak into a microphone that is electrically connected to the system). As another example, for a distributed system, whereby parts of the system are located in different places, the talker may provide the input via a telephone or via the internet. In this manner, the selection of the speech fragments may be performed remote to the talker, such as at a server (e.g., web-based applications server).

As shown at block 220, the speech fragments are selected based on the talker input. For input comprising the talker's voice, the speech fragments may comprise phonemes, diphones, and/or syllables from the talker's own voice. Or, the system may analyze the talker's voice, and analyze various characteristics of the voice (such as fundamental frequency, formant frequencies, etc.) to select the optimum set of speech fragments. In a server based system, the server may perform the analysis of the optimum set of voices, compile the voice streams, generate a file (such as an MP3 file), and download the file to play on the local device. In this manner, the intelligence of the system (in terms of selecting the optimum set of speech fragments and generating the voice streams) may be resident on the server, and the local device may be responsible only for outputting the speech streams (e.g., playing the MP3 file). For input comprising attributes of the talker, the attributes may be used to select a set of speech fragments. For example, in an internet-based system, the talker may send via the internet to a server his or her attributes or actual speech recordings. The server may then access a database containing multiple sets of speech fragments (e.g., one set of speech fragments for a male age 15-20; a second set of speech fragments for female age 15-20; a third set of speech fragments for male age 20-25; etc.), and select a subset of the speech fragments in the database based on talker attributes (e.g., if the talker attribute is "male," the server may select each set of speech fragments that are tagged as "male").

As shown at block 230, the speech fragments are deployed and/or stored. Depending on the configuration of the system (i.e., whether the system is a standalone or distributed system), the speech fragments may be deployed and/or stored. In a distributed system, for example, the speech fragments may be deployed, such as by sending the speech fragments from a server to the talker via the internet, via a telephone, via an e-mail, or downloaded to a thumb-drive. In a standalone system, the speech fragments may be stored in a database of the standalone system.

Figure 4:
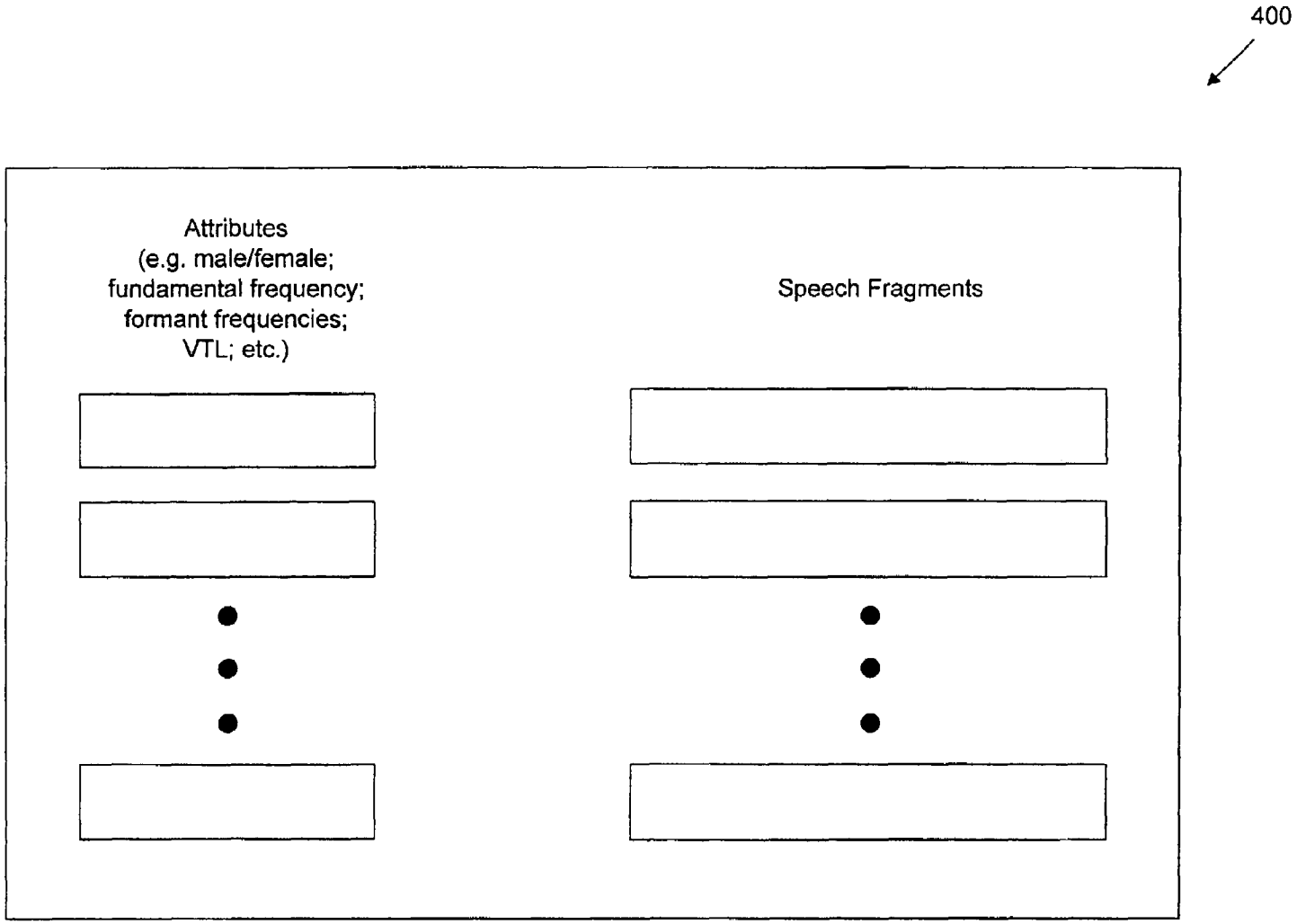
FIG. 4 is an example of a memory that correlates attributes of speech fragments with the corresponding speech fragments.

Alternatively, the speech fragments may be determined in a non-modified manner. For example, the speech fragment database may comprise a collection of voice samples from individuals who are not the talker. An example of a collection of voice samples is depicted in database 400 in FIG. 4. In the context of an internet-based system, a user may access a web-site and download a non-modified set of speech fragments, such as that depicted in FIG. 4. The voice samples in the non-modified database may be based on standard test sentences or other similar source material. As an alternative, the fragments may be randomly chosen from source material. The number of individual voices in the collection may be sufficiently large to cover the range of voice characteristics in the general population and with sufficient density such that voice privacy may be achieved by selecting a subset of voices nearest the talker's voice properties (in block 120, selecting the speech fragments), as discussed in more detail below. The voices may be stored pre-fragmented or may be fragmented when streams are formed. As shown in FIG. 4, the streams may include a header listing the speech parameters of the voice (such as male/female, fundamental frequency, formant frequencies, etc.). This information may be used to find the best candidate voices in the selection procedure (block 120). Alternatively, the talker may send his/her voice to a server. The server may analyze the voice for various characteristics, and select the optimal set of voices based on the various characteristics of the talker's voice and the characteristics of the collection of voice samples, as discussed above. Further, the server may download the optimal set of voices, or may generate the speech streams, sum the speech streams, and download a stereo file (containing two channels) to the local device.

Figure 3:
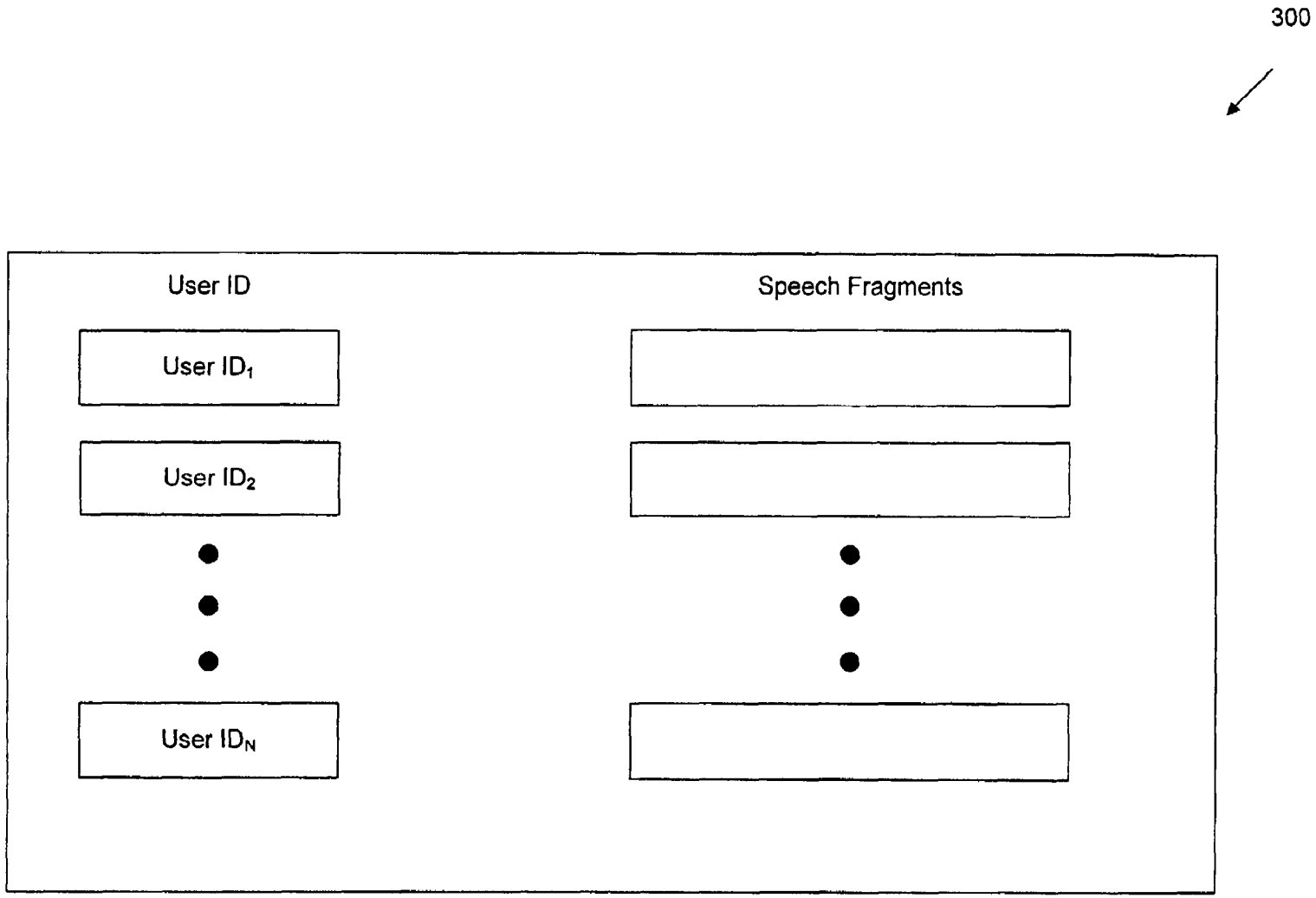
FIG. 3 is an example of a memory that correlates talkers with the talkers' speech fragments.

As discussed above, the system may be for a single user or for multiple users. In a multi-user system, the speech fragment database may include speech fragments for a plurality of users. The database may be resident locally on the system (as part of a standalone system) or may be a network database (as part of a distributed system). A modified speech fragment database 300 for multiple users is depicted in FIG. 3. As shown, there are several sets of speech fragments. Correlated with each speech fragment is a user identification (ID). For example, User $ID_1$, may be a number and/or set of characters identifying "John Doe." Thus, the speech fragments for a specific user may be stored and tagged for later use.

As discussed above, the system may tailor the system for multiple users (either multiple users speaking serially or multiple users speaking simultaneously). For example, the system may tailor for multiple talkers who speak one after another (i.e., a first talker enters an office, engages the system and leaves, and then a second talker enters an office, engages the system and then leaves). As another example, the system may tailor for multiple talkers who speak simultaneously (i.e., two talkers having a conversation in an office). Further, the system may tailor selecting of the speech fragments in a variety of ways, such as based on the identity of the talker(s) (see FIG. 5) or based on the characteristics of the speech (FIGS. 6 and 8).

Figure 5:
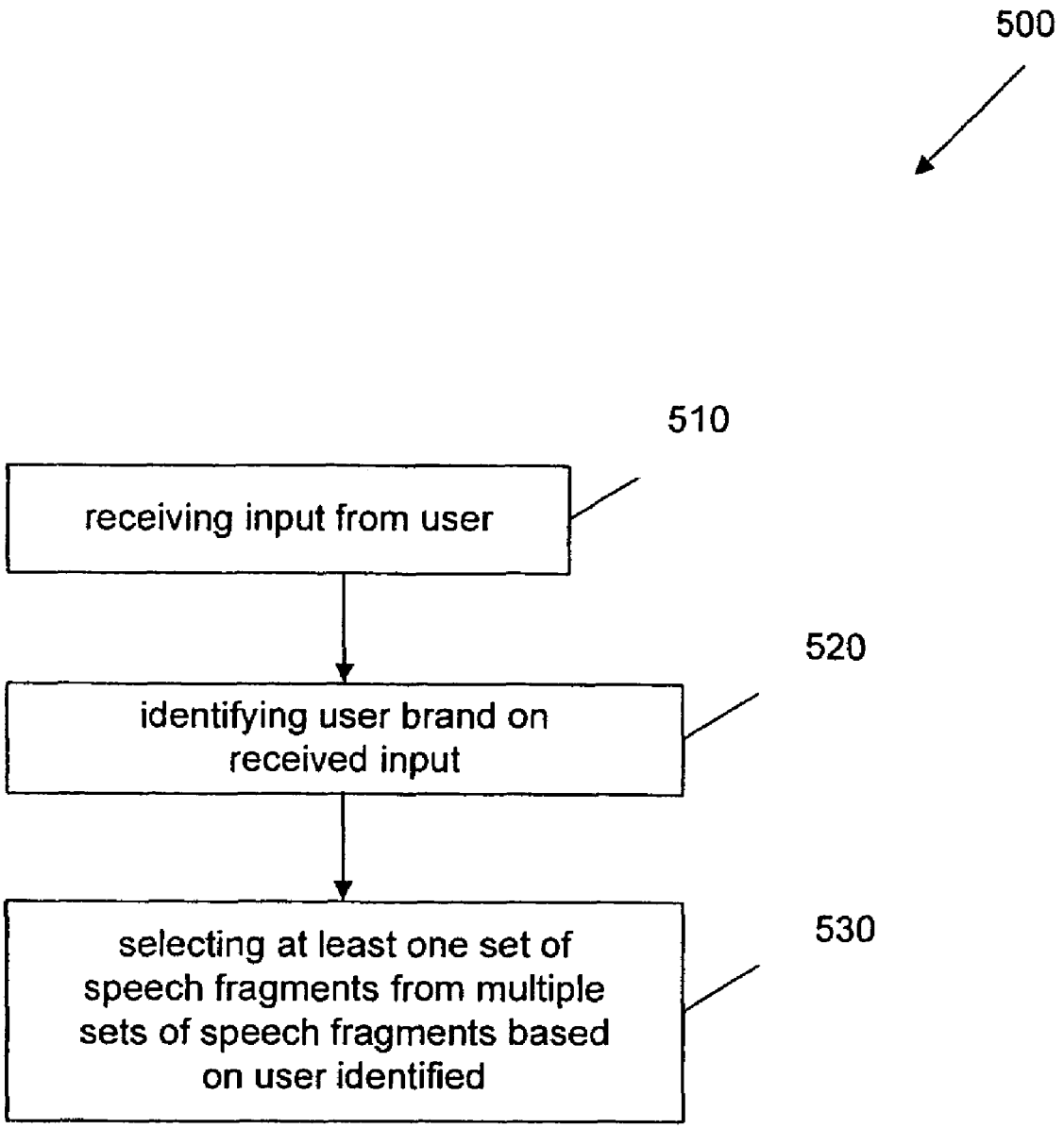
FIG. 5 is an example of a flow diagram for selecting speech fragments in a multi-talker system where the talkers speak serially.

Referring to FIG. 5, there is shown one example of a flow diagram 500 for selecting speech fragments in a multi-talker system where the talkers speak serially. The speech fragment database may include multiple sets of speech fragments, as depicted in FIG. 3. This may account for multiple potential talkers who may use the system. As shown at block 510, the input is received from the talker. The input may be in various forms, including automatic (such as an RFID tag, Bluetooth connection, WI-FI, etc.) and manual (such as a voice input from the talker, a keypad input, or a thumbdrive input, etc.). Based on the input, the talker may be identified by the system. For example, the talker's voice may be analyzed to determine that he is John Doe. As another example, the talker may wear an RFID device that sends a tag. The tag may be used as a User ID (as depicted in FIG. 3) to identify the talker. In this manner, a first talker may enter an office, engage the system in order to identify the first talker, and the system may select speech fragments modified to the first talker. A second talker may thereafter enter the same or a different office, engage the system in order to identify the second talker, and the may select speech fragments modified to the second talker.

Figure 6:
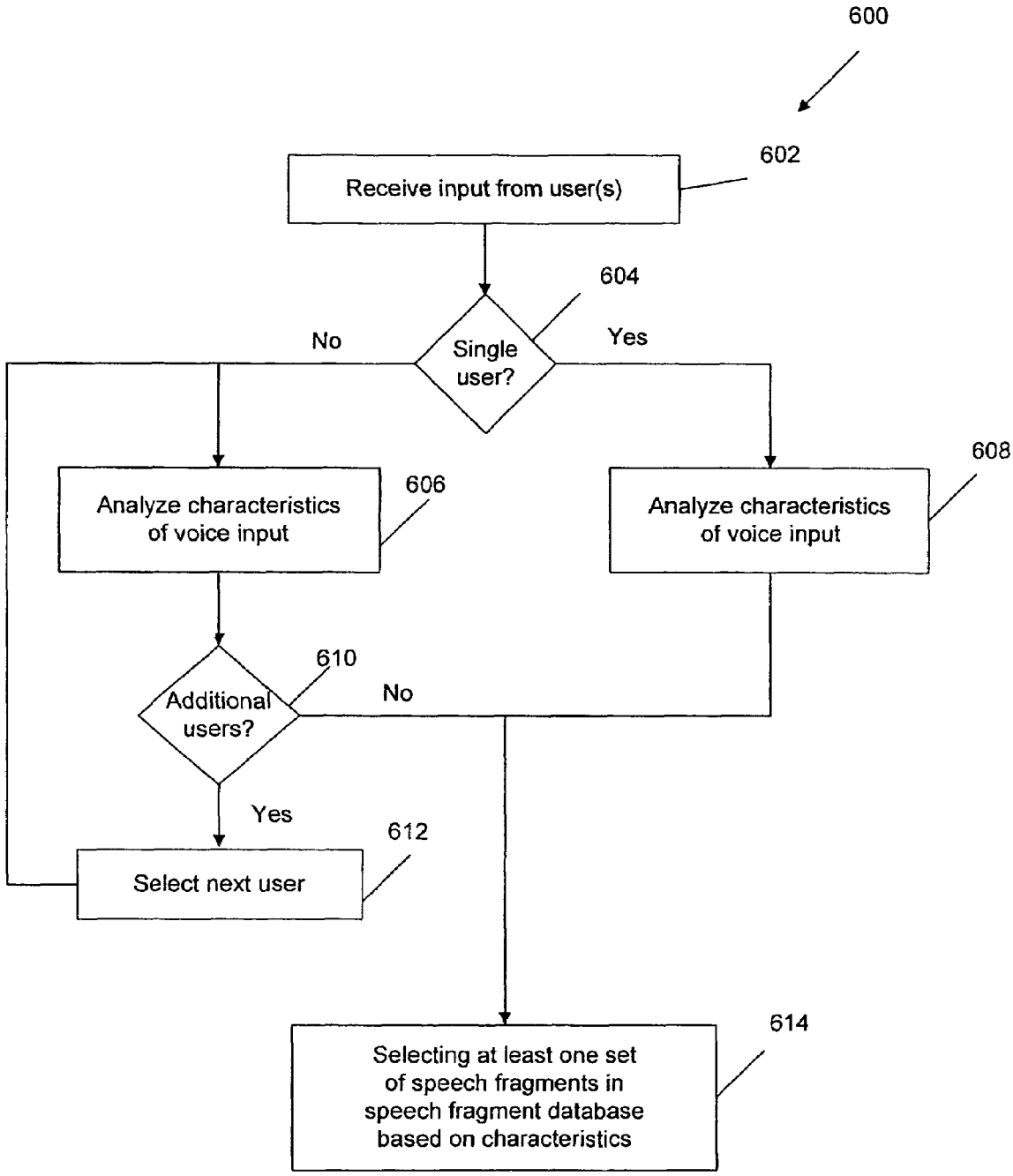
FIG. 6 is an example of a flow diagram for selecting speech fragments in a multi-talker privacy apparatus where the talkers are engaged in a conversation.

Referring to FIG. 6, there is shown another example of a flow diagram 600 for selecting speech fragments in a multi-talker system where there are potentially simultaneous talkers. As shown at block 602, input is received from one or more talkers. As shown at block 604, the system determines whether there is a single talker or multiple talkers. This may be performed in a variety of ways. As one example, the system may analyze the speech including whether there are multiple fundamental frequencies to determine if there are multiple talkers. Or, multiple characteristics of the voice may be analyzed. For example, if the fundamental frequencies are close together, other attributes, such as the $F_1$, may be analyzed. As another example, the system may determine whether there are multiple inputs, such as from multiple automatic input (e.g., multiple RFID tags received) or multiple manual input (e.g., multiple thumbdrives received). If there is a single talker, at least one characteristic of the talker may be analyzed, as shown at block 608. Examples of characteristic of the talker may include the voice of the talker or the identity of the talker. Based on the characteristic(s) of the talker, one or more sets of speech fragments may be selected, as shown at block 614. For example, the characteristic(s) of the talker may comprise the fundamental frequency, the formant frequencies, etc., as discussed in more detail in FIG. 8. These characteristics may then be used to select a set of speech fragments which match, or closely match the characteristic(s). As another example, the characteristic(s) may comprise an identity of the talker(s). The identity may then be used to select a set of speech fragments. Further, more than one characteristic may be used to select the set or sets of speech fragments. For example, characteristics, such as fundamental frequency, the formant frequencies, etc., may be used to select one or more sets of speech fragments that closely match the properties of the voice. Also, the identity of the speaker may be used to select the set of speech fragments based on the talker's own voice. Both sets of speech fragments (those that closely match the properties of the talker's voice and those are the talker's own voice) may be used.

Figure 7:
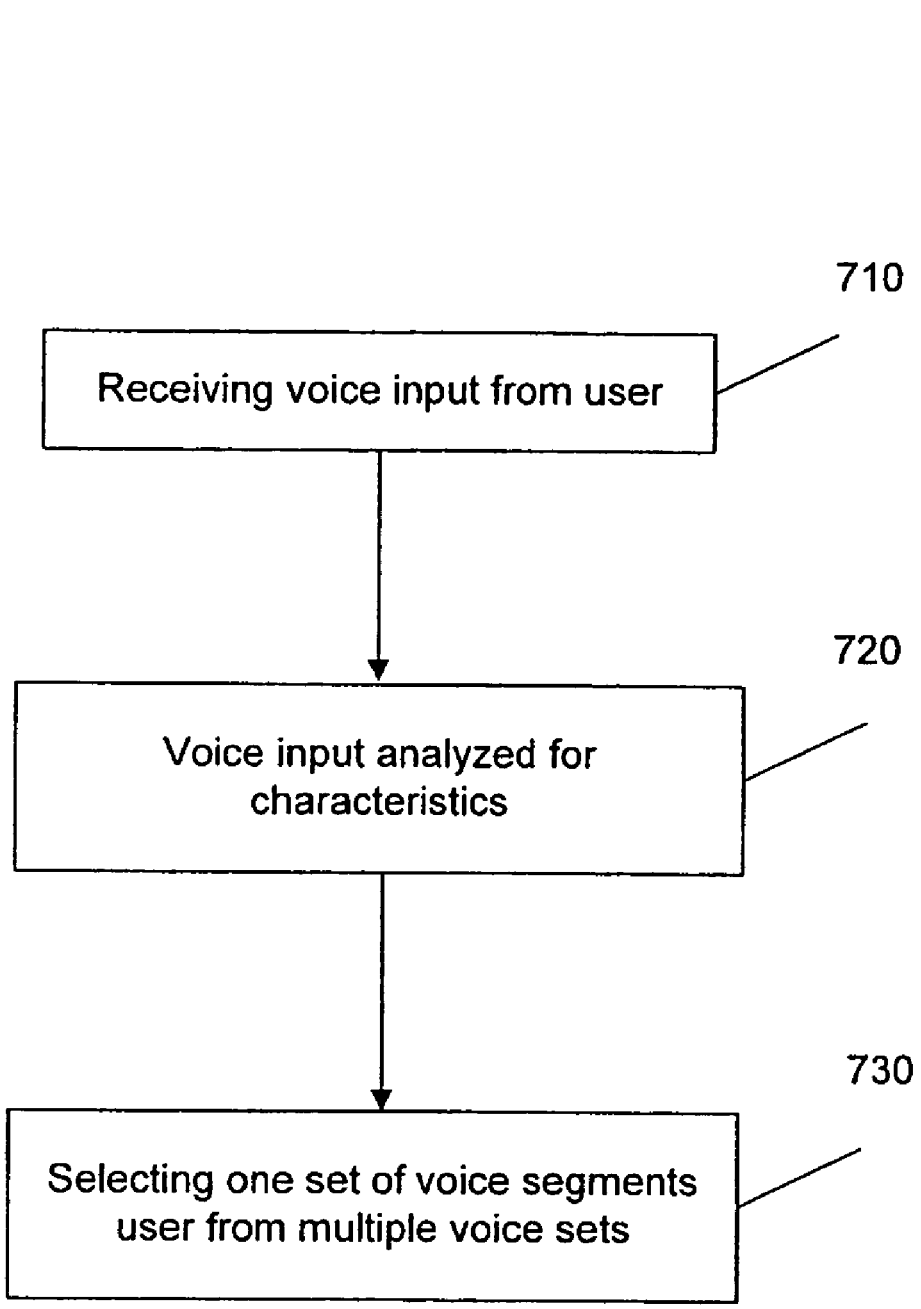
FIG. 7 is an example of a flow diagram for selecting speech fragments in a modified manner.

Referring to FIG. 7, there is shown another flow diagram 700 for selecting speech fragments in a modified manner. A person's speech may vary from day-to-day. In order to better match a person's voice to pre-stored speech fragments in the database, the person may record multiple sets of voice input for storage in the database in order to account for variations in a user's voice. At initialization of the database, the system may analyze the multiple sets of voice input and may tag each set of voice input, such as a particular pitch, pace, etc. During system use, the person's voice may be received, as shown at block 710. The voice input may then be analyzed for any characteristic, such as pace, pitch, etc., as shown at block 720. Using the characteristic(s) analyzed, one or more sets of the voice fragments may be selected from the multiple sets of voice fragments that best matches the current characteristics of the user, as shown at block 730. As discussed above, the set(s) of voice fragments may include: (1) the set(s) that closely match the characteristic(s) of voices that are independent and not based on the voice of the talker; (2) the set that is based on the talker's own voice; or (3) a combination of (1) and (2).

Figure 8:
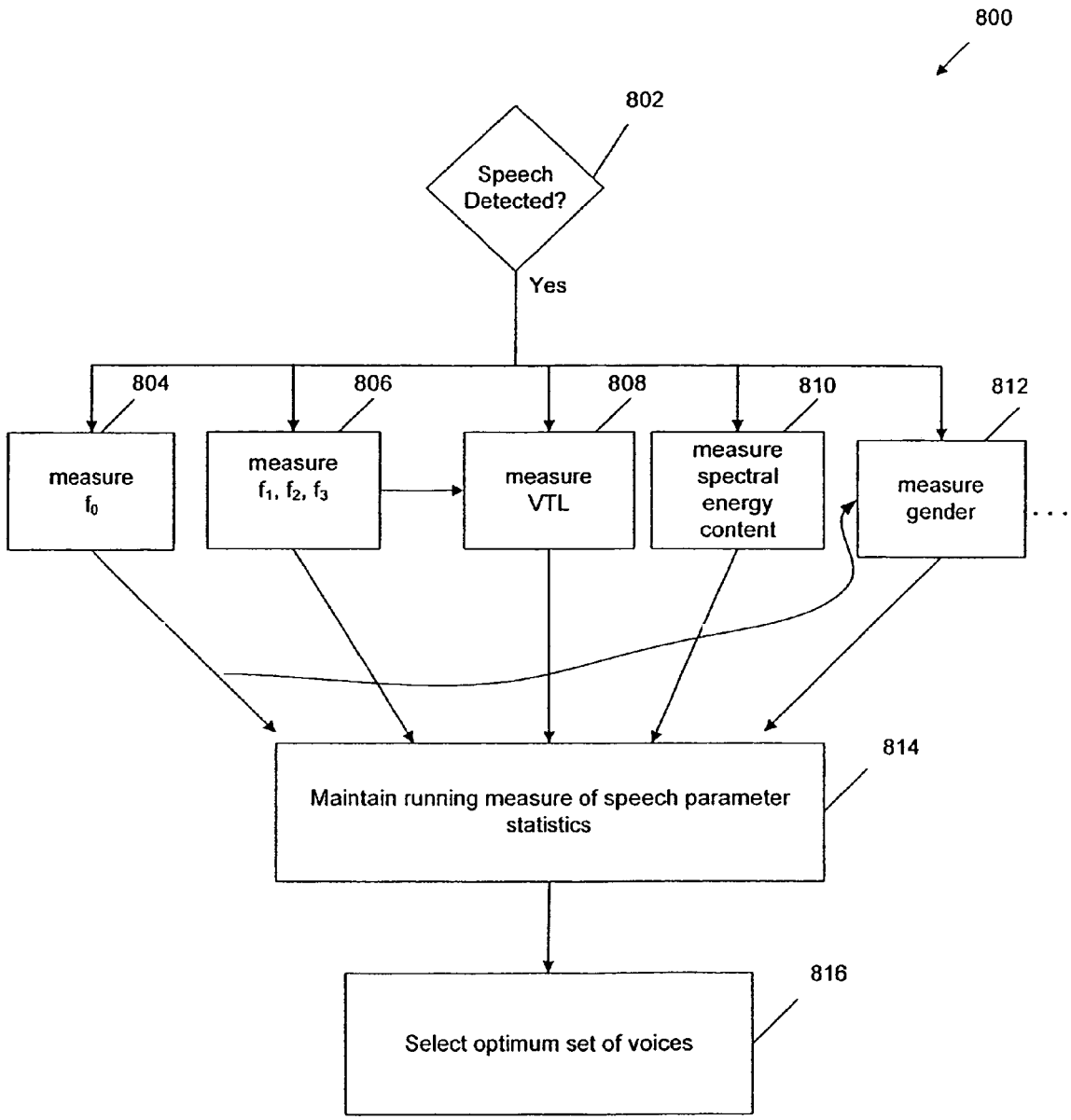
FIG. 8 is an example of a flow diagram for tailoring the speech fragments.

Referring to FIG. 8, there is shown a specific flow diagram for tailoring the speech fragments. The talker's voice may be analyzed for various characteristics or parameters. The parameters may comprise: the fundamental frequency $f_0$; formant frequencies ($f_1$, $f_2$, $f_3$); vocal tract length (VTL); spectral energy content; gender; language (e.g., English, French, German, Spanish, Chinese, Japanese, Russian, etc.); dialect (e.g., New England, Northern, North Midland, South Midland, Southern, New York City, Western), upper frequency range (prominence of sibilance), etc.

The various parameters may be weighted based on relative importance. The weighting may be determined by performing voice privacy performance tests that systematically vary the voices and measure the resulting performance. From this data, a correlation analysis may be performed to compute the optimum relative weighting of each speech property. Once these weightings are known, the best voices may be determined using a statistical analysis, such as a least-squares fit or similar procedure.

An example of a database is shown in FIG. 4. The database includes speech fragments for a range of the various characteristics, including a range of fundamental frequencies, formant frequencies, etc.

One process for determining the required range and resolution of the parameters is to perform voice privacy performance listening tests while systematically varying the parameters. One talker's voice with known parameters may be chosen as the source. Other voices with known parameters may be chosen as base speech to produce voice privacy. The voice privacy performance may be measured, then new voices with parameters that are quantifiably different from the original set are chosen and tested. This process may be continued until the performance parameter becomes evident. Then, a new source voice may be chosen and the process is repeated to verify the previously determined parameter.

A specific example of this process comprises determining the desired range and resolution of the fundamental pitch frequency (f0) parameter. The mean and standard deviation of male $f_0$ is 120 Hz and 20 Hz, respectively. Voice recordings are obtained whose $f_0$ span the range from 80 Hz to 160 Hz (2 standard deviations). A source voice is chosen with an $f_0$ of 120 Hz. Four jamming voices may be used with approximately 10 Hz spacing between their $f_0$. Voice privacy performance tests may be run with different sets of jamming voices with two of the $f_0$s below 120 Hz and two above. The difference between the source $f_0$ and the jamming $f_0$s may be made smaller and the performance differences noted. These tests may determine how close the jamming $f_0$s can be to a source voice $f_0$ to achieve a certain level of voice privacy performance. Similarly, the jamming ID spacing may also be tested. And, other parameters may be tested.

As shown in block 802 of FIG. 8, the first step in measuring talker speech parameters is to determine if speech is present. There are many techniques that may be used for performing this task. One method is based on one-pole lowpass filters using the absolute value of the input. Two of these filters may be used; one using a fast and other using a slow time constant. The slow level estimator is a measure of the background noise. The fast level estimator is a measure of the speech energy. Speech is said to be detected when the fast level estimator exceeds the slow level estimator by a predetermined amount, such as 6 dB. Further, the slow estimator may be set to be equal to the fast estimator when the energy is falling. Other features, such as speech bandpass filtering, may be used to optimize determining if speech is present.

As shown at block 804, the fundamental pitch frequency $f_0$ is measured. There are several techniques for measuring $f_0$. One technique is to use a zero-crossing detector to measure the time between the zero-crossings in the speech waveform. If the zero-crossing rate is high, this indicates that noisy, fricative sounds may be present. If the rate is relatively low, then the average rate may be computed and an $f_0$ estimate may be the reciprocal of the average rate.

As shown at block 806, the formant frequencies $f_1$, $f_2$, and $f_3$ may be measured. The formant frequencies may be varied by the shape of the mouth and create the different vowel sounds. Different talkers may use unique ranges of these three frequencies. One method of measuring these parameters is based on linear predictive coding (LPC). LPC may comprise an all-pole filter estimate of the resonances in the speech waveform. The location of the poles may estimate the formant frequencies.

As shown at block 808, the vocal tract length (VTL) is measured. One method of estimating VTL of the talker is based on comparing measured formant frequencies to known relationships between formant frequencies. The best estimate may then be used to derive the VTL from which such formant frequencies are created.

As shown at block 810, the spectral energy content is measured. The measurement of the spectral energy content, such as the high frequency content in the speech, may help identify talkers who have significance sibilance ('sss') in their speech. One way to measure this is to compute the ratio of high frequency to total frequency energy during unvoiced (no $f_0$) portions of the speech.

As shown at block 812, the gender is measured. Determining the gender of the talker may be useful as a means for efficient speech database searches. One way to do this is based on $f_0$. Males and females have unique ranges of $f_0$. A low $f_0$ may classify the speech as male and a high $f_0$ may classify the speech as female.

Since speech may be viewed as a dynamic signal, some or all of the above mentioned parameters may vary with time even for a single talker. Thus, it is beneficial to keep track of the relevant statistics of these parameters (block 814) as a basis for finding the optimum set of voices in the speech database. In addition, statistics with multiple modes could identify the presence of multiple talkers in the environment. Examples of relevant statistics may include the average, standard deviation, and upper and lower ranges. In general, a running histogram of each parameter may be maintained to derive the relevant parameters as needed.

As shown at block 816, the optimum set of voices is selected. One method of choosing an optimum set of voices from the speech database is to determine the number of separate talkers in the environment and to measure and keep track of their individual characteristics. In this scenario, it is assumed that individual voices characteristics can be separated. This may be possible for talkers with widely different speech parameters (e.g., male and female). Another method for choosing an optimum voice set is taking the speech input as one "global voice" without regard for individual talker characteristics and determining the speech parameters. This analysis of a "global voice," even if more than one talker is present, may simplify processing.

During the creation of the speech database, such as the database depicted in FIG. 4, a range of sample speech is collected such that the desired range and resolution of the important speech parameters are adequately represented in the database. This process may include measuring voice privacy performance with systematic speech parameter variations. A correlation analysis of this data may be performed on this data using voice privacy performance (dB SPL needed to achieve confidential privacy) as the dependent variable and differences between the source talkers' speech parameters and the "disrupter" speech parameters (i.e., Δf0, Δf1, Δf2, Δf3, ΔVTL, Δfhigh, etc.) as the independent variables. This analysis yields the relative importance of each speech parameter in determining overall voice privacy performance.

In addition, these correlations may be used as the basis of a statistical analysis, such as to form a linear regression equation, that can be used to predict voice privacy performance given source and disrupter speech parameters. Such an equation takes the following form:

$$\text{Voice Privacy Level}=R0*\Delta f0+R1*\Delta f1+R2*\Delta f2+R3*\Delta f3+R4*\Delta VTL+R5*\Delta fhigh+\text{etc.}+\text{Constant}.$$

This correlation factors R0-Rx may be normalized between zero and one with the more important parameters having correlation factors closer to one.

The above equation may be used to choose the N best speech samples in the database to be output. For example, N may equal 4 so that 4 streams are created. Fewer or greater number of streams may be created, as discussed below.

The measured source speech parameters (see blocks 804, 806, 810, 812) may be input into the equation and the minimum Voice Privacy Level (VPL) is found from calculating the VPL from the stored parameters associated with each disrupter speech in the database. The search may not need to compute VPL for each candidate speech in the database. The database may be indexed such that the best candidate matches can be found for the most important parameter (e.g., $f_0$) and then the equation used to choose the best candidate from this subset in the database.

Figure 9:
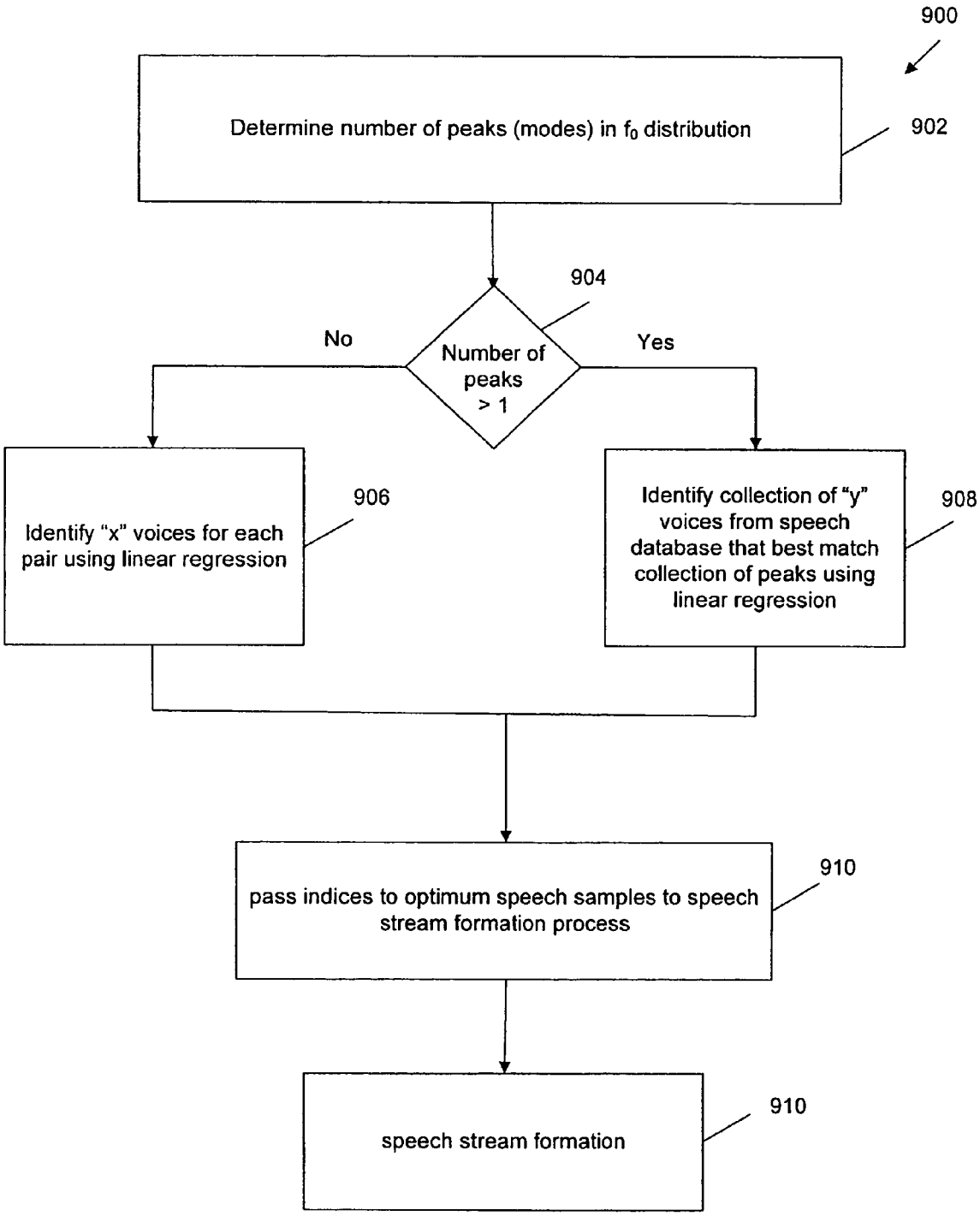
FIG. 9 is an example of a flow diagram for selecting speech fragments with single or multiple users.

Referring to FIG. 9, there is shown a flow diagram 900 for selecting speech fragments with single or multiple users. The measured speech parameters used to compute Δf0, Δf1, Δf2, Δf3, ΔVTL, Δhigh, etc. may be based on the mean values of their respective parameters. In the case of multiple voices, a search may first be made to determine the number of peaks in the $f_0$ distribution, as shown at block 902. Each peak in the f0 distribution may represent an individual voice. As shown in block 904, it is determined if the number of peaks is greater than 1. If so, then it is determined that multiple talkers are present. If not, it is determined that a single talker is present. If a single talker is present, "x" of the best voices for each peak are determined. "x" may be equal to 4 voices, or may be less or greater than 4 voices. The determination of the optimum voices may be as described above. For multiple talkers, a predetermined number of voices, such as "y" voices may be determined for each peak. Since generating a great number of voices may tend to towards white noise, a maximum number of voices may be determined. For example, the maximum number of voices may be 12 voices, however fewer or greater numbers of maximum voices may be used. Thus, for a maximum of 12 voices, for 2-3 peaks (translating into identifying 2 or 3 talkers), four voices may be generated for each peak. For 4 peaks, three voices per peak may be generated. For 5 voices, 2 of the most prominent peaks will use 3 voices and the remainder may use 2 voices. For 6 voices, 2 voices per peak may be used. This process is dynamic in that it adjusts as peaks change through time. The numbers provided are merely for illustrative purposes.

As shown at block 910, the indices are passed for optimum speech samples to the speech stream formation process. And, the speech stream is formed, as shown at block 910.

The speech fragment selection procedure may output its results to the speech stream formation procedure. One type of output of the speech fragment selection procedure may comprise a list of indices pointing to a set of speech fragments that best match the measured voice(s). For example, the list of indices may point to various sets of speech sets depicted in FIG. 4. This information may be used to form speech signals to be output to the system loudspeaker(s), as described below. This process may be similar to that disclosed in U.S. Provisional Patent Application No. 60/684,141, filed on May 24, 2005, which is hereby incorporated by reference in its entirety. Applicants further incorporate by reference U.S. Provisional Patent Application No. 60/642,865, filed on Jan. 10, 2005. In the present case, the database may comprise generic speech fragments that are independent and not based on the talker. Further, the database may contain fragmented and/or unfragmented speech (to be fragmented as needed in real-time by the system). Or, the database may contain speech that is designed to be fragmented in nature. For example, the talker may be asked to read into a microphone a series of random, disjunctive speech. In this manner, the speech input to the system may already be fragmented so that the system does not need to perform any fragmentation.

The speech stream formation process may take the indices (such as 4 indices for one identified talker, see FIG. 9) to voice samples in the speech database and produces to two speech signals to be output. The indices may be grouped by their associated target voice that has been identified. The table below lists example indices for 1-6 target voices.

| # of target voices | Voice Index list |
|---|---|
| 1 | V11, V12, V13, V14 |
| 2 | V11, V12, V13, V14; V21, V22, V23, V24 |
| 3 | V11, V12, V13, V14; V21, V22, V23, V24; V31, V32, V33, V34 |
| 4 | V11, V12, V13; V21, V22, V23; V31, V32, V33; V41, V42, V43 |

-continued

| # of target voices | Voice Index list |
|---|---|
| 5 | V11, V12, V13; V21, V22, V23; V31, V32; V41, V42; V51, V52 |
| 6 | V11, V12; V21, V22; V31, V32; V41, V42; V51, V52; V61, V62 |

The voices (Vij; i denoting the target voice) may be combined to form the two speech signals (S1, S2) as shown in the table below.

| # of target voices | Output formation |
|---|---|
| 1 | S1 = V11 + V13; S2 = V12 + V14 |
| 2 | S1 = V11 + V13 + V21 + V23; S2 = V12 + V14 + V22 + V24 |
| 3 | S1 = V11 + V13 + V21 + V23 + V31 + V33; S2 = V12 + V14 + V22 + V24 + V32 + V34 |
| 4 | S1 = V11 + V13 + V22 + V31 + V42 + V51; S2 = V12 + V21 + V23 + V32 + V41 + V52 |
| 5 | S1 = V11 + V13 + V22 + V31 + V42 + V51; S2 = V12 + V21 + V23 + V32 + V41 + V52 |
| 6 | S1 = V11 + V22 + V31 + V42 + V51 + V62; S2 = V12 + V21 + V32 + V41 + V52 + V61 |

The process of forming a single, randomly fragmented voice signal (Vij) may be similar to that disclosed in U.S. Provisional Patent Application No. 60/684,141 (incorporated by reference in its entirety). The index into the speech database may point to a collection of speech fragments of a particular voice. These fragments say be of a size of phonemes, diphones, and/or syllables. Each voice may also contain its own set of indices that point to each of its fragments. To create the voice signal, these indices to fragments may be shuffled and then played out one fragment at a time until the entire shuffled list is exhausted. Once a shuffled list is exhausted, the list may be reshuffled and the voice signal continues without interruption. This process may occur for each voice (Vij). The output signals (S1, S2) are the sum of the fragmented voices (Vij) created as described in the Table above.

As discussed above, the talker's input speech may be input in a fragmented manner. For example, the input may comprise several minutes of continuous speech fragments that may already be randomized. These speech fragments may be used to create streams by inserting a time delay. For example, to create 4 different speech streams for a 120 seconds talker input, a time delay of 30 seconds, 60 seconds and 90 seconds may be used. The four streams may then be combined to create two separate channels for output, with the separate channels being stored in stereo format (such as in MP3). The stereo format may be downloaded for play on a stereo system (such as an MP3 player).

As discussed above, the auditory system can also segregate sources if the sources turn on or off at different times. The privacy apparatus may reduce or minimize this cue by outputting a stream whereby random speech elements are summed on one another so that the random speech elements at least partially overlap. One example of the output stream may include generating multiple, random streams of speech elements and then summing the streams so that it is difficult for a listener to distinguish individual onsets of the real source. The multiple random streams may be summed so that multiple speech fragments with certain characteristics, such as 2, 3 or 4 speech fragments that exhibit phoneme characteristics, may be heard simultaneously by the listener. In this manner, when multiple streams are generated (from the talker's voice and/or from another voice(s)), the listener may not be able to discern that there are multiple streams being generated. Rather, because the listener is exposed to the multiple streams (and in turn the multiple phonemes or speech fragments with other characteristics), the listener may be less likely to discern the underlying speech of the talker. Alternatively, the output stream may be generated by first selecting the speech elements, such as random phonemes, and then summing the random phonemes.

Figure 10:
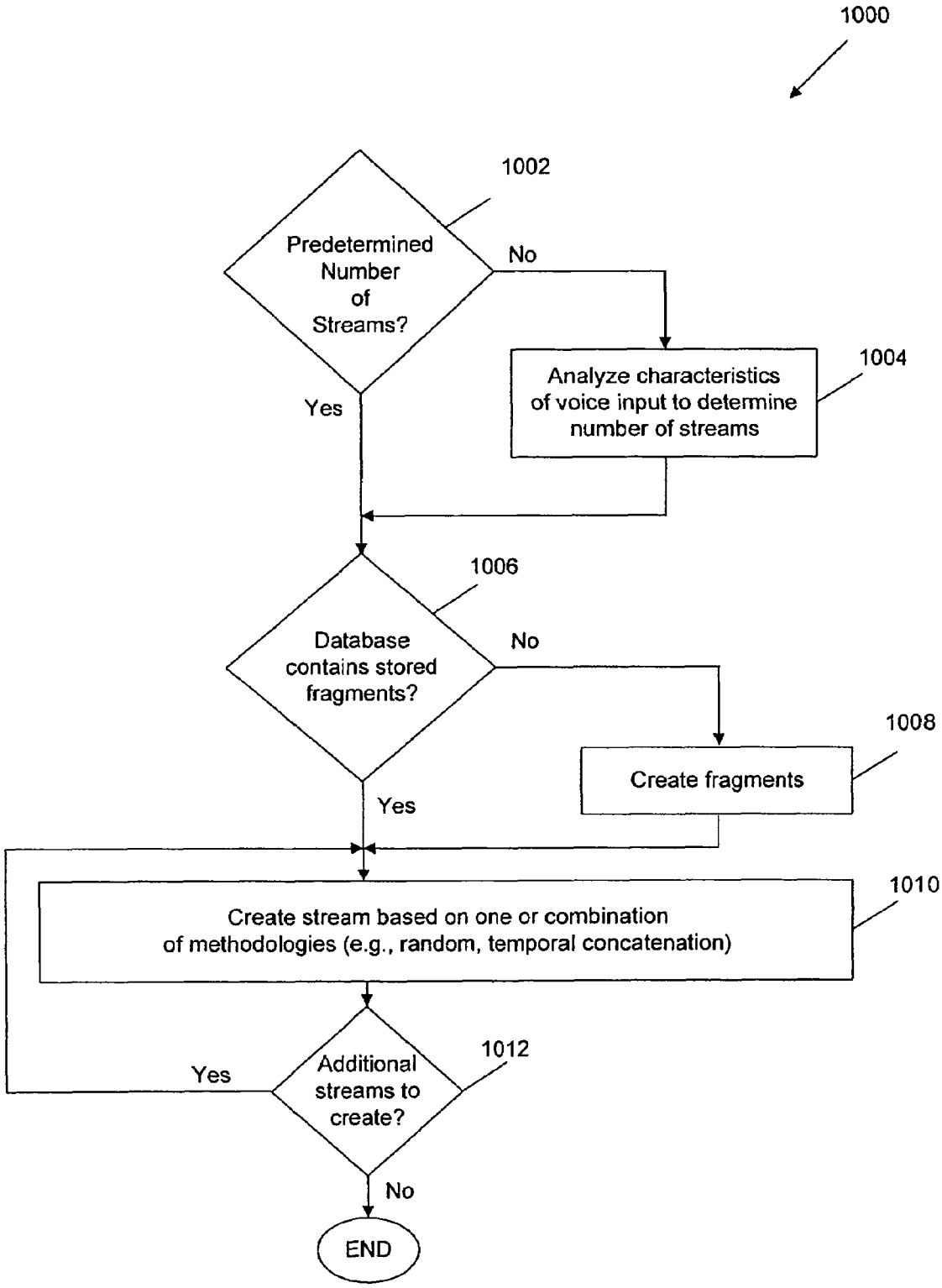
FIG. 10 is an example of a flow diagram of a speech stream formation for a single talker.

Referring to FIG. 10, there is shown a flow chart 1000 of an example of a speech stream formation for a single talker. As shown at block 1002, it is determined whether there are a predetermined number of streams. The number of streams may be predetermined (such as 4 streams as discussed above). Or, the number of streams may be dynamic based on any characteristic of the speech. If there are not a predetermined number of streams, the voice input is analyzed in order to determine the number of streams, as shown at block 1004. Further, it is determined whether the database contains stored fragments, as shown at block 1006. As discussed above, the database may contain fragments or may contain non-fragmented speech. In the event the database contains non-fragmented speech, the fragments may be created in real-time, as shown at block 1008. Further, the stream may be created based on one or a combination of methodologies, such as random, temporal concatenation, as shown at block 1010. Finally, it is determined whether there are additional streams to create, as shown at block 1012. If so, the logic loops back. Alternatively, the system does not need to create the streams. As discussed above, the system may receive via a downloaded a stereo file, such as an MP3 file, which may already have the 2 channels for output to the loudspeakers. The output to the speakers may be continuous by playing the stereo file until the end of the file, and then looping back to the beginning of the stereo file.

Figure 11:
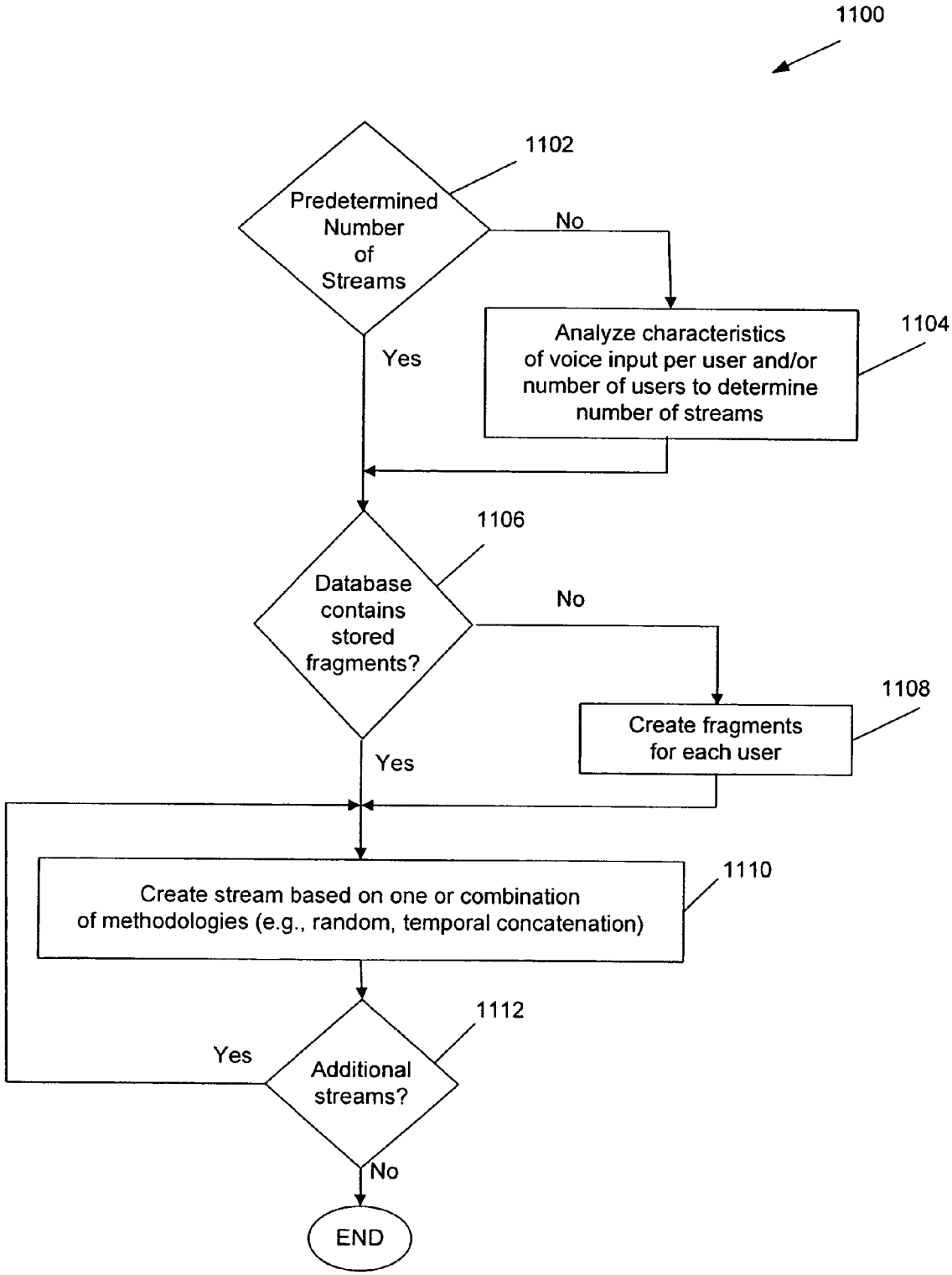
FIG. 11 is an example of a flow diagram of a speech stream formation for multiple talkers.

Referring to FIG. 11, there is shown a flow chart 1100 of an example of a speech stream formation for multiple talkers. The flow chart 1100 is similar to flow chart 1000, except for the analysis of the characteristics of the voice input. As shown at block 1102, it is determined whether there are a predetermined number of streams. If there are not a predetermined number of streams, the voice input is analyzed for each talker and/or for the number of talkers in order to determine the number of streams, as shown at block 1104. Further, it is determined whether the database contains stored fragments, as shown at block 1106. In the event the database contains non-fragmented speech, the fragments may be created in real-time, as shown at block 1108. As discussed above, fragmenting the speech may not be necessary. Further, the stream may be created based on one or a combination of methodologies, such as random, temporal concatenation, as shown at block 1110. Alternatively, the system does not need to create fragments, such as if the talker's input is sufficiently fragmented. Finally, it is determined whether there are additional streams to create, as shown at block 1112. If so, the logic loops back. As discussed above, the creation of the streams may not be necessary.

Figure 12:
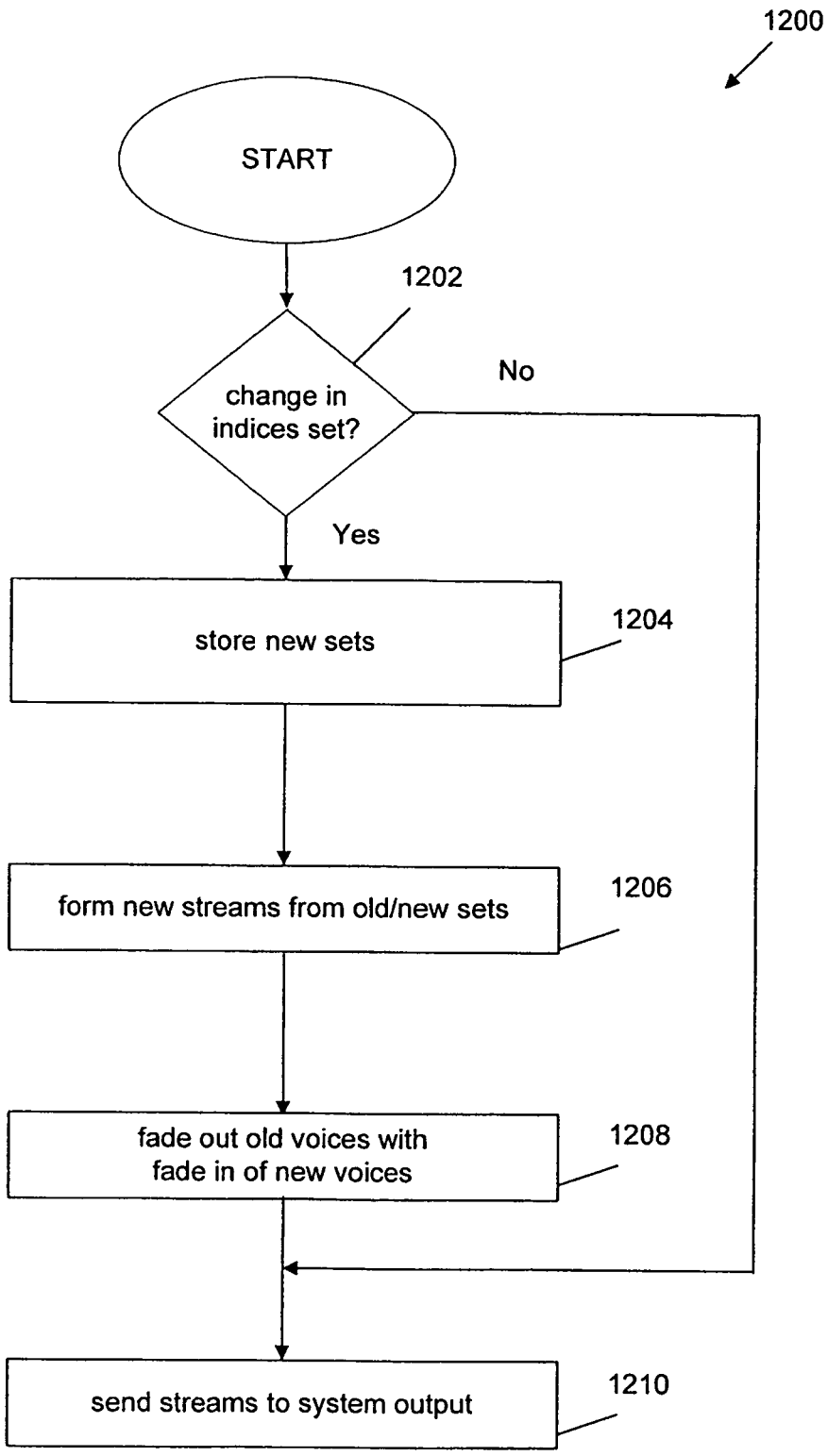
FIG. 12 is another example of a flow chart for speech stream formation.

Referring to FIG. 12, there is shown a flow chart 1200 of another example of a speech stream formation. Speech stream formation may be an ongoing process. New voices may be added and old voices may be removed as conference participants change and are subsequently detected by the speech fragment selection process. As shown at block 1202, it is determined whether there is a change in the indices set. A change in indices indicates a new voice is present or an old voice has been deleted. After which, the new sets are stored (block 1204) and the new streams are formed from the old/new sets (block 1206). When new voices (Vij) are added, the new voice may be slowly amplified over a period of time (such as approximately 5 seconds) until it reaches the level of the other voices currently being used. When a voice is removed from the list, its output may be slowly decreased in amplitude over a period of time (such as approximately 5 seconds) after which it is fully removed (block 1208). Or, its output may be immediately or nearly immediately decreased in amplitude (i.e., less than one second, such as from approximately 0 to 100 milliseconds). In such cases when a new voice is added and a current voice is removed during the same time period, the addition and removal may occur simultaneously such that extra voices are temporarily output. The purpose of the slow ramp on/off of voices is to make the overall output sound smooth without abrupt changes. The streams may then be sent to the system output, as shown at block 1210.

The system output function may receive one or a plurality of signals. As shown in the tables above, the system receives the two signals (S1, S2) from the stream formation process. The system may modify the signal (such as adjust the signal's amplitude), and send them to the system loudspeakers in the environment to produce voice privacy. As discussed above, the output signal may be modified or non-modified to various characteristic(s) of the talker(s), listener(s), and/or environment. For example, the system may use a sensor, such as a microphone, to sense the talker's or listener's environment (such as background noise or type of noise), and dynamically adjust the system output. Further, the system may comprise a manual volume adjustment control during the installation procedure to bring the system to the desired range of system output. The dynamic output level adjustment may operate with a slow time constant (such as approximately two seconds) so that the level changes are gentle and not distracting.

Figure 13:
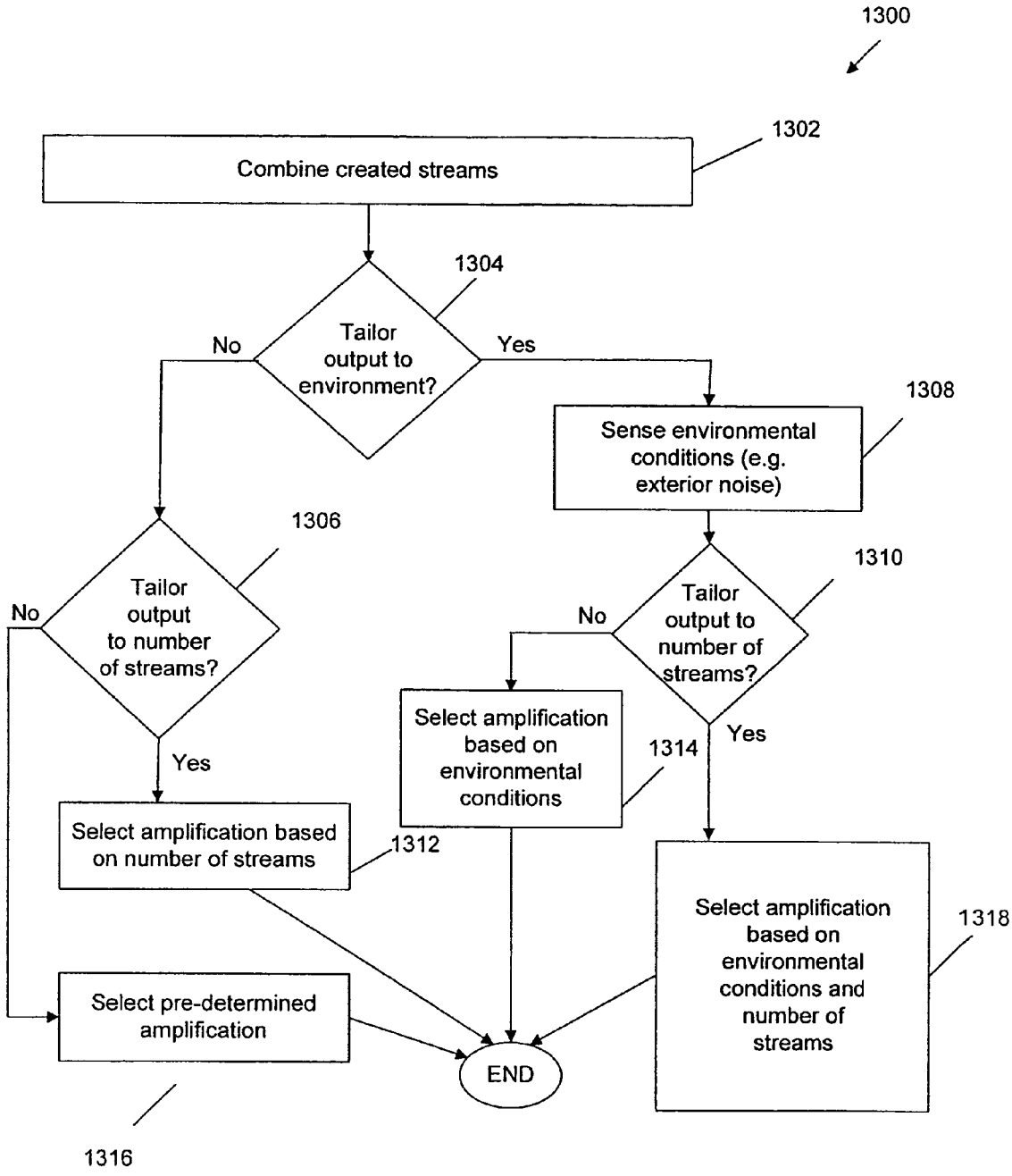
FIG. 13 is an example of a flow chart for determining a system output.

Referring to FIG. 13, there is shown a flow chart 1300 of a determining a system output. As shown at block 1302, the created streams are combined. Further, it is determined whether to tailor the output to the environment (such as the environment of the talker and/or listener), as shown at block 1304. If so, the environmental conditions (such as exterior noise) may be sensed, as shown at block 1308. Further, it is determined whether the output should be tailored to the number of streams generated, as shown at block 1310. If so, the signal's output is modified based on both the environmental conditions and the number of streams, as shown at block 1318. If not, the signal's output is modified based solely on the environmental conditions, as shown at block 1314. If the output is not tailored to the environment, it is determined whether the output should be tailored to the number of streams generated, as shown at block 1306. If so, the signal's output is modified based solely on the number of streams, as shown at block 1312. If not, the signal's output is not modified based on any dynamic characteristic and a predetermined amplification is selected, as shown at block 1316.

Figure 14:
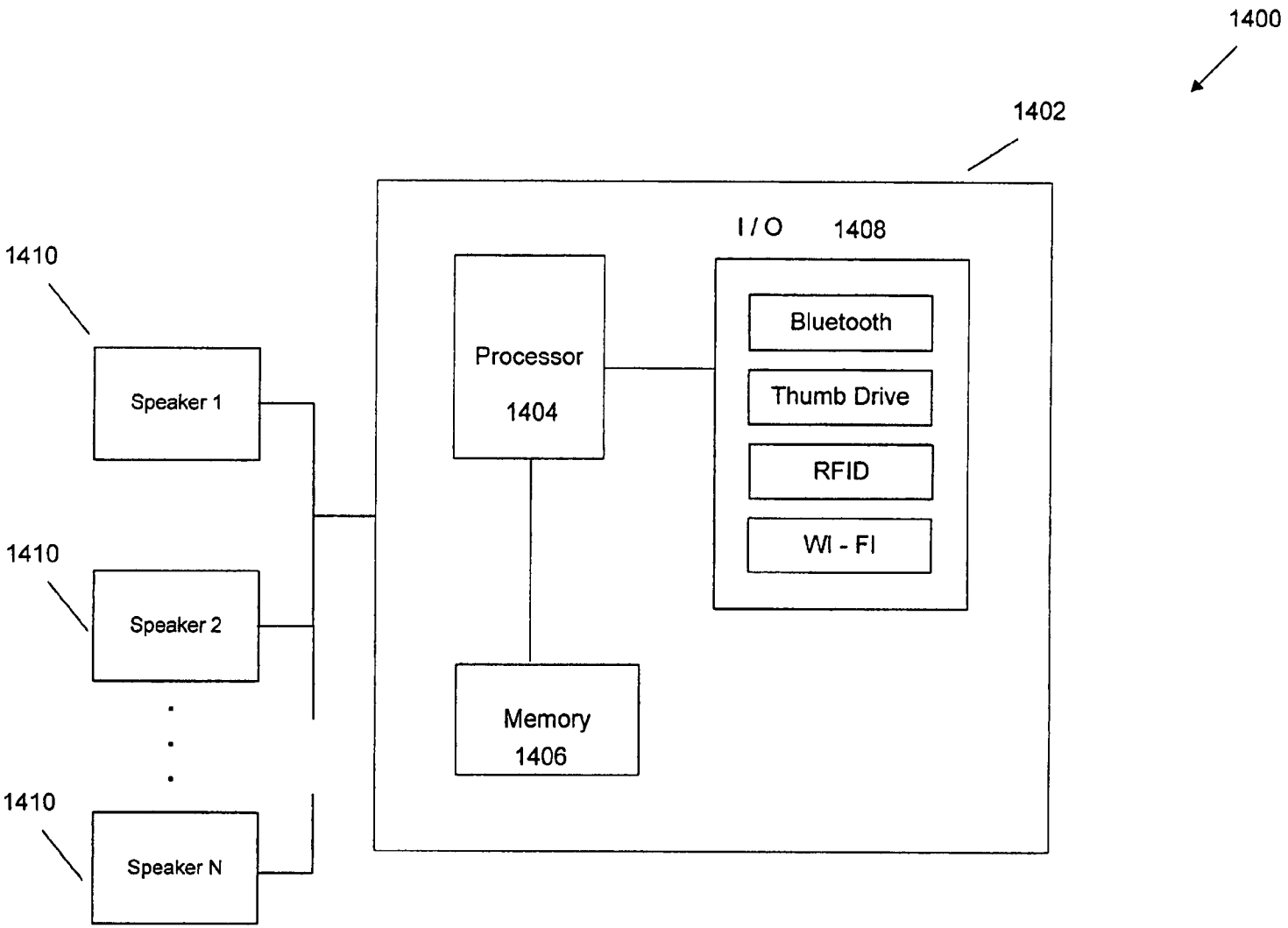
FIG. 14 is an example of a block diagram of a privacy apparatus that is configured as a standalone system.
Figure 15:
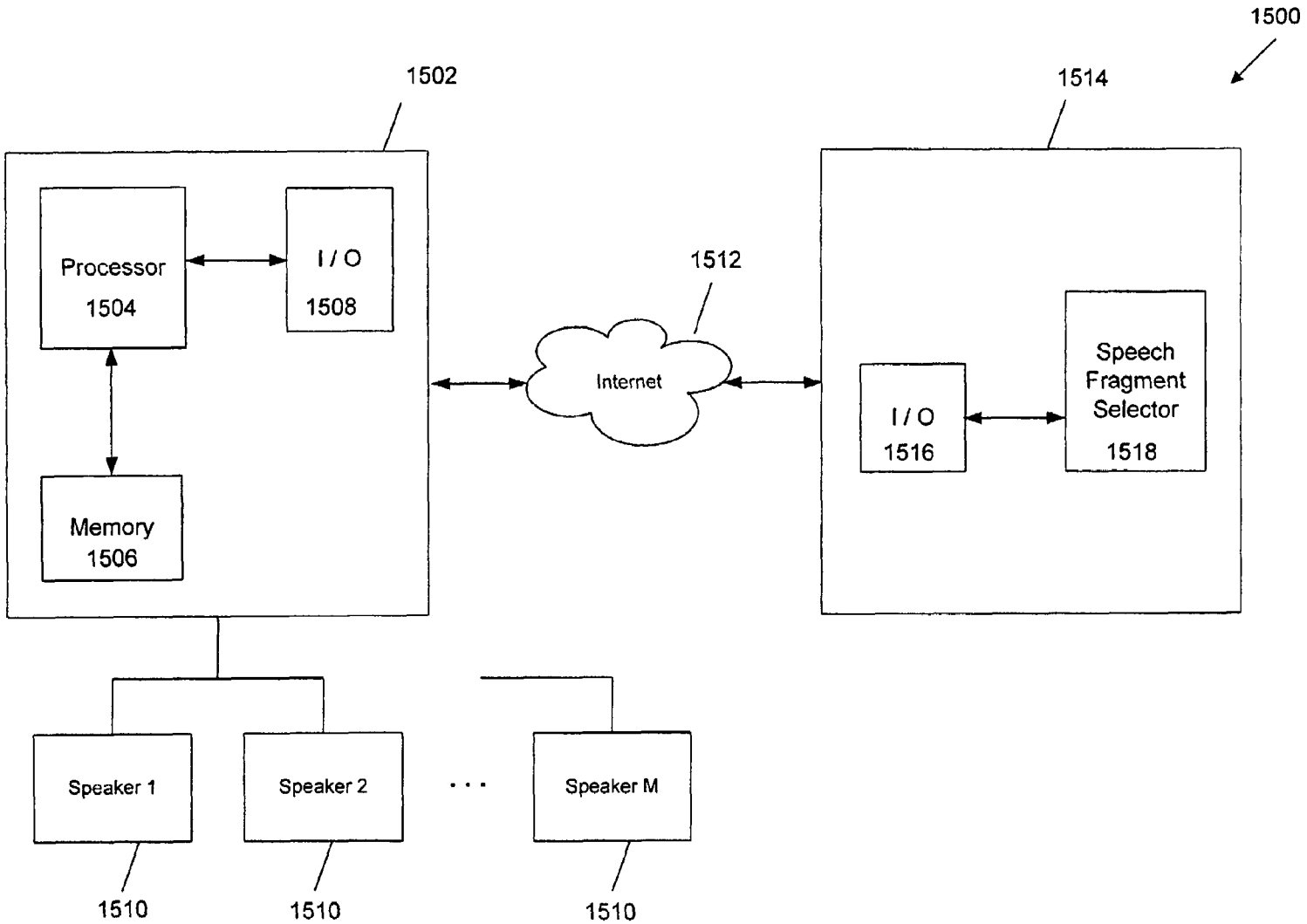
FIG. 15 is an example of a block diagram of a privacy apparatus that is configured as a distributed system.

As discussed above, the privacy apparatus may have several configurations, including a self-contained and a distributed system. FIGS. 14 and 15 show examples of block diagrams of system configurations, including a self-contained system and a distributed system, respectively. Referring to FIG. 14, there is shown a system 1400 that includes a main unit 1402 and loudspeakers 1410. The main unit may include a processor 1404, memory 1406, and input/output (I/O) 1408. FIG. 14 shows I/O of Bluetooth, thumb drive, RFID, WI-FI, switch, and keypad. The I/O depicted in FIG. 14 is merely for illustrative purposes and fewer, more, or different I/O may be used.

Further, there may be 1, 2, or "N" loudspeakers. The loudspeakers may contain two loudspeaker drivers positioned 120 degrees off axis from each other so that each loudspeaker can provide 180 degrees of coverage. Each driver may receive separate signals. The number of total loudspeakers systems needed may be dependent on the listening environment in which it is placed. For example, some closed conference rooms may only need one loudspeaker system mounted outside the door in order to provide voice privacy. By contrast, a large, open conference area may need six or more loudspeakers to provide voice privacy.

Referring to FIG. 15, there is shown another system 1500 that is distributed. In a distributed system, parts of the system may be located in different places. Further, various functions may be performed remote from the talker. For example, the talker may provide the input via a telephone or via the internet. In this manner, the selection of the speech fragments may be performed remote to the talker, such as at a server (e.g., web-based applications server). The system 1500 may comprise a main unit 1502 that includes a processor 1504, memory 1506, and input/output (I/O) 1508. The system may further include a server 1514 that communicates with the main unit via the Internet 1512 or other network. In the present distributed system, the function of determining the speech fragment database may be determined outside of the main unit 1502. The main unit 1502 may communicate with the I/O 1516 of the server 1514 (or other computer) to request a download of a database of speech fragments. The speech fragment selector unit 1518 of the server 1514 may select speech fragments from the talker's input. As discussed above, the selection of the speech fragments may be based on various criteria, such as whether the speech fragment exhibits phoneme characteristics. The server 1514 may then download the selected speech fragments or chunks to the main unit 1502 for storage in memory 1506. The main unit 1502 may then randomly select the speech fragments from the memory 1506 and generate multiple voice streams with the randomly selected speech fragments. In this manner, the processing for generating the voice streams is divided between the server 1514 and the main unit 1502.

Alternatively, the server may randomly select the speech fragments using speech fragment selector unit 1518 and generate multiple voice streams. The multiple voice streams may then be packaged for delivery to the main unit 1502. For example, the multiple voice streams may be packaged into a .wav or an MP3 file with 2 channels (i.e., in stereo) with a plurality of voice streams being summed to generate the sound on one channel and other plurality of voice streams being summed to generate the sound on the second channel. The time period for the .wav or MP3 file may be long enough (e.g., 5 to 10 minutes) so that any listeners may not recognize that the privacy sound is a .wav file that is repeatedly played. Still another distributed system comprises one in which the database is networked and stored in the memory 1506 of main unit 1502.

In summary, speech privacy is provided that may be based on the voice of the person speaking and/or voice(s) other than the person speaking. This may permit the privacy to occur at lower amplitude than previous maskers for the same level of privacy. This privacy may disrupt key speech interpretation cues that are used by the human auditory system to interpret speech. This may produce effective results with a 6 dB advantage or more over white/pink noise privacy technology.

It is therefore intended that the foregoing detailed description be regarded as illustrative rather than limiting, and that it be understood that it is the following claims, including all equivalents, that are intended to define the spirit and scope of this invention. For example, the geometries and material properties discussed herein and shown in the embodiments of the figures are intended to be illustrative only. Other variations may be readily substituted and combined to achieve particular design goals or accommodate particular materials or manufacturing processes.

The invention claimed is:

1. A system for disrupting speech of a talker at a listener in an environment, the system comprising:

a speech database comprising speech that is at least partly other than speech from the talker;

a processor; and at least one speaker, wherein the processor is configured to:

access the speech database;

select a subset of the speech database based on at least one characteristic of the talker; and form at least one speech stream from the subset of the speech database, the speech stream for output on the at least one speaker, the at least one speech stream being formed by selecting a plurality of speech signals from the subset of the speech database and by generating at least one privacy output signal for output on the at least one speaker, the at least one privacy output signal comprised of the speech signals being summed with one another so that the speech signals at least partly overlap one another.

2. The system of claim 1, wherein the speech database comprises speech fragments; and wherein the processor selects the speech fragments from the speech fragment database based on at least one characteristic of the talker, the speech fragments selected being a subset of the speech fragments in the speech database.

3. The system of claim 2, wherein the speech fragments comprise a plurality of sets of speech fragments, each set having associated characteristics.

4. The system of claim 3, wherein the characteristics of the sets of speech fragments are selected from the group consisting of fundamental frequency, formant frequencies, pace, pitch, gender, and accent.

5. The system of claim 3, wherein the processor selects at least one set of speech fragments from a plurality of sets of speech fragments in the speech database based on comparing the characteristic of the talker with the characteristics of the sets of speech fragments in the speech fragment database.

6. The system of claim 1, wherein the processor further determines the at least one characteristic of the talker.

7. The system of claim 6, wherein the processor analyzes speech of the talker in real-time in order to determine the at least one characteristic of the talker; and wherein the processor selects a subset of the speech database based on the real-time analyzing of the speech.

8. The system of claim 7, wherein the processor analyzes at least one aspect of the speech selected from the group consisting of fundamental frequency, formant frequencies, pace, and pitch.

9. The system of claim 6, wherein the processor determining the at least one characteristic of the talker comprises:

the processor identifying the talker; and the processor accessing the database to determine the at least one characteristic correlated to the identity of the talker.

10. The system of claim 1, wherein the talker comprises multiple talkers; and wherein the processor selects the subset based on at least one characteristic of at least one of the multiple talkers.

11. The system of claim 10, wherein the processor selects the subset by analyzing speech from the multiple talkers to identify a current talker.

12. The system of claim 11, wherein the processor analyzes the speech in real-time to determine the at least one characteristic of at least one of the multiple talkers.

13. The system of claim 10, wherein the multiple talkers comprises a number of talkers speaking in a conversation; and wherein a number of speech streams formed is based on the number of talkers.

14. The system of claim 1, wherein the processor forms at least one speech stream from the subset of the speech database by forming multiple speech streams.

15. The system of claim 14, wherein the processor forms multiple speech streams by forming each of the multiple speech streams and by summing each of the multiple speech streams to form a single output stream for output on the at least one speaker.

16. The system of claim 1, wherein the speech database consists of speech other than the speech from the talker.

17. A method for disrupting speech of a talker at a listener in an environment, the method comprising:

accessing a speech database comprising speech that is at least partly other than speech from the talker;

selecting a subset of the speech database based on at least one characteristic of the talker; and forming at least one speech stream from the subset of the speech database, the speech stream for output on at least one speaker, wherein forming at least one speech stream from the subset of the speech database comprises:

selecting a plurality of speech signals from the subset of the speech database; and generating at least one privacy output signal for output, the at least one privacy output signal comprised of the speech signals being summed with one another so that the speech signals at least partly overlap one another.

18. The method of claim 17, wherein the speech database comprises speech fragments; and wherein selecting a subset of the speech database comprises selecting speech fragments from the speech fragment database based on at least one characteristic of the talker, the speech fragments selected being a subset of the speech fragments in the speech database.

19. The method of claim 18, wherein the speech fragments comprise a plurality of sets of speech fragments, each set having associated characteristics.

20. The method of claim 19, wherein the characteristics of the sets of speech fragments are selected from the group consisting of fundamental frequency, formant frequencies, pace, pitch, gender, and accent.

21. The method of claim 17, further comprising determining the at least one characteristic of the talker.

22. The method of claim 21, wherein determining the at least one characteristic of the talker comprises analyzing speech of the talker in real-time; and wherein selecting a subset of the speech database is based on the real-time analyzing of the speech.

23. The method of claim 22, wherein analyzing analyzes at least one aspect of the speech selected from the group consisting of fundamental frequency, formant frequencies, pace, and pitch.

24. The method of claim 21, wherein determining the at least one characteristic of the talker comprises:

identifying the talker; and accessing a database to determine the at least one characteristic correlated to the identity of the talker.

25. The method of claim 17, wherein the talker comprises multiple talkers; and wherein selecting the subset is based on at least one characteristic of at least one of the multiple talkers.

26. The method of claim 25, wherein selecting the subset comprises analyzing speech from the multiple talkers to identify a current talker.

27. The method of claim 26, wherein analyzing speech from the multiple talkers to identify a current talker comprises analyzing the speech in real-time to determine the at least one characteristic of at least one of the multiple talkers.

28. The method of claim 25, wherein the multiple talkers comprises a number of talkers speaking in a conversation; and wherein a number of speech streams formed is based on the number of talkers.

29. The method of claim 17, wherein forming at least one speech stream from the subset of the speech database comprises forming multiple speech streams.

30. The method of claim 29, wherein forming multiple speech streams comprises forming each of the multiple speech streams and summing each of the multiple speech streams to form a single output stream for output on the at least one speaker.

31. The method of claim 17, wherein the speech database consists of speech other than the speech from the talker.

32. A system for disrupting speech of a talker at a listener in an environment, the system comprising:

a speech database comprising speech that is at least partly other than speech from the talker;

a processor; and at least one speaker, wherein the processor is configured to:

access the speech database;

select a subset of the speech database based on at least one characteristic of the talker; and form a single output stream from the subset of the speech database for output on the at least one speaker, the single output stream being formed by generating multiple speech streams and by summing each of the multiple speech streams to form the single output stream.

33. A method for disrupting speech of a talker at a listener in an environment, the method comprising:

accessing a speech database comprising speech that is at least partly other than speech from the talker;

selecting a subset of the speech database based on at least one characteristic of the talker; and forming at least one speech stream from the subset of the speech database, the speech stream for output on at least one speaker, wherein forming at least one speech stream from the subset of the speech database comprises forming multiple speech streams, and wherein forming multiple speech streams comprises forming each of the multiple speech streams and summing each of the multiple speech streams to form a single output stream for output on the at least one speaker.

* * * * *